US007295796B1

(12) United States Patent
Murakami et al.

(10) Patent No.: US 7,295,796 B1
(45) Date of Patent: Nov. 13, 2007

(54) IMAGE FORMING APPARATUS HAVING A TEMPORARY TONER HOLDING DEVICE AND A TONER COLLECTING DEVICE

(75) Inventors: Eisaku Murakami, Kanagawa (JP); Hideo Yoshizawa, Saitama (JP); Hiroyuki Nagashima, Kanagawa (JP); Yoshiyuki Kimura, Tokyo (JP); Hideki Zemba, Kanagawa (JP); Eiji Kurimoto, Shizuoka (JP); Takeshi Uchitani, Kanagawa (JP); Toshio Koike, Kanagawa (JP); Masato Yanagida, Tokyo (JP); Masami Tomita, Shizuoka (JP); Atsushi Sampe, Kanagawa (JP); Naohiro Kumagai, Kanagawa (JP); Takeshi Shintani, Kanagawa (JP); Masanori Kawasumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 10/652,505

(22) Filed: Sep. 2, 2003

(30) Foreign Application Priority Data

| | | |
|---|---|---|
| Aug. 30, 2002 | (JP) | 2002-254142 |
| Aug. 30, 2002 | (JP) | 2002-254221 |
| Nov. 18, 2002 | (JP) | 2002-333963 |
| Nov. 18, 2002 | (JP) | 2002-334040 |
| Nov. 26, 2002 | (JP) | 2002-342125 |

(51) Int. Cl.
*G03G 15/24* (2006.01)

(52) U.S. Cl. ..... 399/150

(58) Field of Classification Search ..... 399/150, 399/149

See application file for complete search history.

(56) References Cited

U.S. PATENT DOCUMENTS

| | | | | |
|---|---|---|---|---|
| 5,701,570 | A * | 12/1997 | Takuma | 399/343 |
| 5,715,501 | A * | 2/1998 | Aita et al. | 430/120 |
| 6,081,679 | A * | 6/2000 | Yamane et al. | 399/71 |
| 6,167,215 | A * | 12/2000 | Miyashiro et al. | 399/66 |
| 6,219,509 | B1 | 4/2001 | Komiya et al. | |
| 6,480,695 | B2 * | 11/2002 | Endo et al. | 399/349 |

(Continued)

FOREIGN PATENT DOCUMENTS

EP 1 115 038 7/2001

(Continued)

OTHER PUBLICATIONS

Computer Translation of JP2002-082573.*

(Continued)

*Primary Examiner*—Quana Grainger
(74) *Attorney, Agent, or Firm*—Oblon, Spivak, McClelland, Maier & Neustadt, P.C.

(57) ABSTRACT

A cleaningless image forming apparatus of the present invention uses spherical toner grains on surfaces of which a charge control agent and/or organic fine grains are present, thereby enhancing efficient image transfer. A brush roller collects, among toner grains left on a photoconductive drum after image transfer, toner grains of polarity opposite to preselected polarity and then releases them to the drum at preselected timing. The toner grains of opposite polarity are then transferred to an intermediate image transfer belt. When the toner grains of opposite polarity pass a charging zone assigned to a charge roller, a bias to the charge roller is interrupted or the charge roller is released from the drum.

37 Claims, 24 Drawing Sheets

U.S. PATENT DOCUMENTS

| | | | |
|---|---|---|---|
| 6,640,076 | B2 | 10/2003 | Shintani |
| 2001/0031414 | A1 | 10/2001 | Yoshida et al. |

FOREIGN PATENT DOCUMENTS

| | | | | |
|---|---|---|---|---|
| EP | 1 132 781 | | | 9/2001 |
| JP | 03-116083 | | | 5/1991 |
| JP | 04-274477 | | | 9/1992 |
| JP | 05-188637 | | | 7/1993 |
| JP | 05-241425 | | | 9/1993 |
| JP | 07098534 | A | * | 4/1995 |
| JP | 08-015901 | | | 1/1996 |
| JP | 08-030163 | | | 2/1996 |
| JP | 8-137198 | | | 5/1996 |
| JP | 8-137205 | | | 5/1996 |
| JP | 08137368 | A | * | 5/1996 |
| JP | 08-152832 | | | 6/1996 |
| JP | 08-328440 | | | 12/1996 |
| JP | 09-054532 | | | 2/1997 |
| JP | 9-211979 | | | 8/1997 |
| JP | 09-305064 | | | 11/1997 |
| JP | 09-325607 | | | 12/1997 |
| JP | 10-282854 | | | 10/1998 |
| JP | 11-190931 | | | 7/1999 |
| JP | 11-305624 | | | 11/1999 |
| JP | 2000-075538 | | | 3/2000 |
| JP | 2000-112180 | | | 4/2000 |
| JP | 2000-194242 | | | 7/2000 |
| JP | 3091323 | | | 7/2000 |
| JP | 2000-242152 | | | 9/2000 |
| JP | 2000-276020 | | | 10/2000 |
| JP | 2001-75448 | | | 3/2001 |
| JP | 2001-117317 | | | 4/2001 |
| JP | 2001-249502 | | | 9/2001 |
| JP | 2001324830 | A | * | 11/2001 |
| JP | 2001-356614 | | | 12/2001 |
| JP | 2002-082464 | | | 3/2002 |
| JP | 2002-082573 | | | 3/2002 |
| JP | 2002-287400 | | | 10/2002 |
| JP | 2003-029588 | | | 1/2003 |

OTHER PUBLICATIONS

U.S. Appl. No. 10/652,505, filed Sep. 2, 2003, Murakami et al.
U.S. Appl. No. 11/289,488, filed Nov. 30, 2005, Shimojo et al.
U.S. Appl. No. 11/372,142, filed Mar. 10, 2006, Zemba.
U.S. Appl. No. 11/554,360, filed Oct. 30, 2006, Katoh et al.
U.S. Appl. No. 10/092,920, filed Mar. 08, 2002, Yamashita et al.
U.S. Appl. No. 10/098,556, filed Mar. 18, 2002, Sugiyama et al.
U.S. Appl. No. 10/103,791, filed Mar. 25, 2002, Suzuki et al.
U.S. Appl. No. 10/112,769, filed Apr. 02,2002, Yamashita et al.
U.S. Appl. No. 10/135,548, filed May 01, 2002, Kami et al.
U.S. Appl. No. 10/163,990, filed Jun. 07, 2002, Yamada et al.
U.S. Appl. No. 10/188,049, filed Jul. 03, 2002, Yamashita et al.
U.S. Appl. No. 10/188,753, filed Jul. 05, 2002, Emoto et al.
U.S. Appl. No. 10/246,601, filed Sep. 19, 2002, Emoto et al.
U.S. Appl. No. 10/244,526, filed Sep. 17, 2002, Tomita et al.
U.S. Appl. No. 10/247,639, filed Sep. 20, 2002, Yamashita et al.
U.S. Appl. No. 10/286,816, filed Nov. 04, 2002, Emoto et al.
U.S. Appl. No. 10/284,177, filed Oct. 31, 2002, Yagi et al.
U.S. Appl. No. 10/285,636, filed Nov. 01, 2002, Ohjimi et al.
U.S. Appl. No. 10/286,791, filed, Nov. 04, 2002, Yamashita et al.
U.S. Appl. No. 10/303,910, filed Nov. 26, 2002, Sampe et al.
U.S. Appl. No. 10/315,935, filed Dec. 11, 2002, Kurimoto et al.
U.S. Appl. No. 10/329,356, filed Dec. 27, 2002, Muramatsu et al.
U.S. Appl. No. 10/352,062, filed Jan. 28, 2003, Yanagida.
U.S. Appl. No. 10/384,662, filed Mar. 11, 2003, Sugino et al.
U.S. Appl. No. 10/394,265, filed Mar. 24, 2003, Nanya et al.
U.S. Appl. No. 10/401,554, filed Mar. 31, 2003 Kimura et al.
U.S. Appl. No. 10/422,839, filed Apr. 25, 2003, Yoshizawa.
U.S. Appl. No. 10/652,505, filed Sep. 02, 2003, Murakami et al.
U.S. Appl. No. 10/652,505, filed Sep. 02, 2003, Murakami et al.
U.S. Appl. No. 11/100,813, filed Apr. 07, 2005, Ojimi et al.
U.S. Appl. No. 10/652,505, filed Sep. 02, 2003, Murakami et al.
U.S. Appl. No. 11/090,565, filed Mar. 28, 2005, Toshio et al.
U.S. Appl. No. 10/652,505, filed Sep. 02, 2003, Murakami et al.
U.S. Appl. No. 10/921,993, filed Aug. 20, 2004, Amemiya et al.
U.S. Appl. No. 10/652,505, filed Sep. 02, 2003, Murakami et al.
U.S. Appl. No. 10/921,923, filed Aug. 20, 2004, Koike et al.
U.S. Appl. No. 10/652,505, filed Sep. 02, 2003, Murakami et al.
U.S. App. No. 10/926,180, filed Aug. 26, 2004, Kimura et al.
U.S. Appl. No. 09/652,505, filed Sep. 02, 2003, Murakami et al.
U.S. Appl. No. 10/884,979, filed Jul. 07, 2004, Fukuchi et al.

* cited by examiner

FIG. 9

| BEFORE TRANSFER | | | AFTER TRANSFER | | |
|---|---|---|---|---|---|
| fc/μm | PULVERIZED TONER (n) | POLYMERIZED TONER (n) | fc/μm | PULVERIZED TONER (n) | POLYMERIZED TONER (n) |
| −4 | 0 | 0 | −4 | 0 | 0 |
| −3.5 | 0 | 0 | −3.5 | 0 | 0 |
| −3 | 0 | 10 | −3 | 0 | 5 |
| −2.5 | 15 | 30 | −2.5 | 0 | 10 |
| −2.25 | 60 | 70 | −2.25 | 0 | 20 |
| −2 | 100 | 130 | −2 | 0 | 30 |
| −1.8 | 180 | 200 | −1.8 | 0 | 50 |
| −1.6 | 300 | 310 | −1.6 | 0 | 80 |
| −1.4 | 350 | 450 | −1.3 | 5 | 140 |
| −1.2 | 450 | 550 | −1.2 | 10 | 210 |
| −1 | 500 | 600 | −1 | 20 | 350 |
| −0.8 | 530 | 520 | −0.8 | 50 | 430 |
| −0.6 | 460 | 400 | −0.6 | 90 | 490 |
| −0.4 | 340 | 200 | −0.4 | 160 | 500 |
| −0.2 | 200 | 100 | −0.2 | 240 | 480 |
| 0 | 120 | 40 | 0 | 330 | 370 |
| 0.2 | 90 | 10 | 0.24 | 400 | 230 |
| 0.5 | 60 | 3 | 0.5 | 440 | 120 |
| 0.6 | 20 | 0 | 0.6 | 450 | 80 |
| 0.8 | 10 | 0 | 0.8 | 400 | 40 |
| 1 | 0 | 0 | 1 | 340 | 20 |
| 1.2 | 0 | 0 | 1.2 | 260 | 5 |
| 1.4 | 0 | 0 | 1.4 | 200 | 0 |
| 1.6 | 0 | 0 | 1.6 | 160 | 0 |
| 1.8 | 0 | 0 | 1.8 | 80 | 0 |
| 2.0 | 0 | 0 | 2.0 | 50 | 0 |
| 2.2 | 0 | 0 | 2.2 | 20 | 0 |
| 2.4 | 0 | 0 | 2.4 | 10 | 0 |
| 2.6 | 0 | 0 | 2.6 | 5 | 0 |
| 2.8 | 0 | 0 | 2.8 | 0 | 0 |
| 3.0 | 0 | 0 | 3.0 | 0 | 0 |
| | 3785 | 3623 | | 3720 | 3660 |

FIG. 10
| TONER MEAN CIRCULARITY | SPEUD OBSERVATION TIME (MIN.) |
|---|---|
| 0.91 | 2040 |
| 0.92 | 3500 |
| 0.93 | 4300 |
| 0.95 | 4550 |
| 0.97 | 4600 |
FIG. 11A
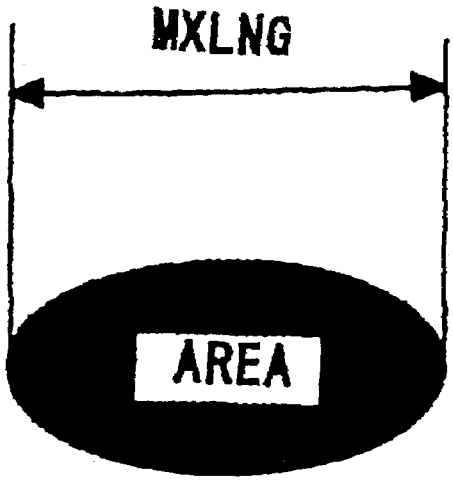
FIG. 11B
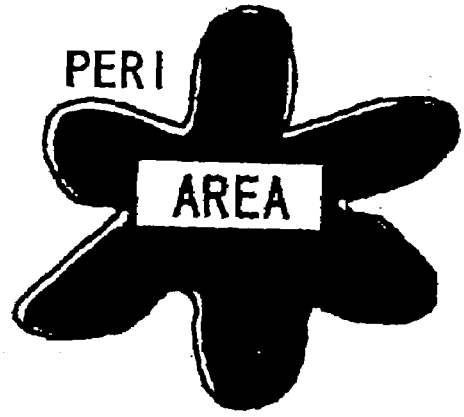

FIG. 26

| VOLUMERIC RESISTIVITY (Ω·cm) | WEIGHT OF TONER ON BRUSH (mg) | | | |
|---|---|---|---|---|
| | 50 | 100 | 150 | 200 |
| 1.00E+01 | ○ | ○ | × | × |
| 1.00E+02 | ○ | ○ | ○ | △ |
| 1.00E+03 | ○ | ○ | ○ | ○ |

FIG. 27

| KIND PRINTS | 30K | 40K | 50K | 60K | 70K | 80K | 90K | 100K |
|---|---|---|---|---|---|---|---|---|
| NORMAL (ACRYLIC) | ○ | ○ | △ | × | × | × | × | × |
| LOOP | ○ | ○ | ○ | ○ | △ | × | × | × |
| SPHERE | ○ | ○ | ○ | ○ | △ | × | × | × |
| NORMAL (URETHANE COAT) | ○ | ○ | ○ | ○ | △ | △ | × | × |
| NYLON | ○ | ○ | ○ | ○ | ○ | △ | × | × |
| POLYESTER | ○ | ○ | ○ | ○ | ○ | × | × | × |
| NYLON WITH CARBON | ○ | ○ | ○ | ○ | ○ | ○ | × | × |
| POLYESTER WITH CARBON | ○ | ○ | ○ | ○ | ○ | ○ | ○ | × |

IMAGE FORMING APPARATUS HAVING A TEMPORARY TONER HOLDING DEVICE AND A TONER COLLECTING DEVICE

BACKGROUND OF THE INVENTION

1. Field of the Invention

The present invention relates to a copier, printer, facsimile apparatus or similar image forming apparatus and a process cartridge for use in the same and more specifically to a tandem image forming apparatus using a simultaneous developing and cleaning system.

2. Description of the Background Art

An image forming apparatus of the type using an electrostatic image transfer system is conventional and configured to form an electric field between a photoconductive drum or similar image carrier and an intermediate image transfer body, sheet conveyor or similar moving member for thereby transferring a toner image formed on the image carrier. In this type of image forming apparatus, some toner is left on the image carrier after the transfer of the toner image to a subject body, e.g., the intermediate image transfer body or a sheet or recording medium. If part of the image carrier on which such residual toner is present is subject to the next image formation, then irregular charging or similar defective charging occurs on the above part of the image carrier and lowers image quality. It is a common practice to remove the residual toner from the image carrier with a cleaning device.

The problem with the cleaning device mentioned above is that it needs an extra space for accommodating a waste toner tank configured to store the residual toner collected from the image carrier and a recycling path along which the residual toner is conveyed to be reused, making the entire apparatus bulky. Particularly, a current trend in the imaging art is toward a tandem image forming apparatus that assigns a particular image carrier to each color in order to meet the increasing demand for high-speed color image formation. If the cleaning device is applied to this kind of image forming apparatus, then a particular cleaning device must be assigned to each of a plurality of image carriers, making the above problem more serious.

To solve the problem stated above, Japanese Patent No. 3,091,323, for example, discloses an image forming apparatus using a simultaneous developing and cleaning system that causes a developing device to collect the residual toner. More specifically, the developing device, originally expected to develop a latent image, is used as cleaning means at the same time, so that a particular cleaning device does not have to be assigned to each image carrier. This contributes a great deal to the size reduction of the apparatus.

Japanese Patent mentioned above further teaches a charging device for the above image forming apparatus that includes a charge roller held in contact with the image carrier for uniformly charging the image carrier. Conventional systems for uniformly charging an image carrier are generally classified into a contact or vicinity type of charging system using a charge roller or similar charging member contacting or adjoining the image carrier and a non-contact type of charging system using a corona charger or similar charger. The non-contact type of charging system has a problem that it produces ozone, NOx (nitrogen oxides) and other discharge products, which are undesirable from the environment standpoint. In this respect, the contact or vicinity type of charging system, which produces a minimum of discharge products, is superior to the contact or vicinity type of charging system. Presumably, therefore, the apparatus taught in the above document promotes both of the size reduction of the apparatus and the reduction of discharge products.

However, the apparatus, using the simultaneous developing and cleaning system and contact or vicinity type of charging system has the following problem left unsolved. Before the residual toner present on the image carrier is conveyed to a developing zone, it contacts and deposits on the charging member, obstructing uniform charging. This prevents the charging member from charging the surface of the image carrier to an expected potential or causes irregular charging or similar defective charging to occur, resulting in short image density, background contamination and other defects. This problem is not particular to the apparatus using the simultaneous developing and cleaning system, but arises so long as the residual toner is conveyed to a position where the image carrier and charging member contact each other without being removed from the image carrier.

On the other hand, a blade type of cleaning device configured to clean the surface of the image carrier with a cleaning blade is predominant today because it sufficiently reduces undesirable black stripes extending in an image in the direction of movement of the above surface. Stated another way, with a bladeless type of cleaning device that does not use a cleaning blade, it is difficult to sufficiently control such black stripes. The bladeless type of cleaning device may use a brush roller for collecting the residual toner or a bias applying member for electrostatically collecting the residual toner. The simultaneous developing and cleaning system stated earlier is one of the bladeless type of cleaning systems.

The blade type of cleaning system has a problem that the edge of the cleaning blade strongly rubs and therefore shaves the entire surface of the image carrier and thereby reduces the life of the image carrier. Particularly, to meet the increasing demand for the size reduction of an image forming apparatus, the circumferential length of the image carrier is decreasing. For example, the diameter of a photoconductive drum, which is a specific form of the image carrier, is decreasing. When the circumferential length of the image carrier is reduced, the cleaning blade is required to rub the image carrier a larger number of times for a single image. It follows that when the blade type of cleaning system is applied to such an image carrier, the life of the image carrier is critically reduced.

By contrast, the bladeless type of cleaning system, which rubs the image carrier more softly than the blade type of cleaning system, successfully extends the life of the image carrier. In addition, load exerted by the bladeless type of cleaning system on the image carrier is lighter than load exerted by the blade type of cleaning system, reducing drive load to act on a driveline assigned to the image carrier. The simultaneous developing and cleaning system, in particular, does not need the extra space to be assigned to the waste toner tank and recycle path stated previously. In this sense, among some different bladeless cleaning systems, the simultaneous developing and cleaning system is advantageous in that it reduces the overall size of the apparatus, while achieving the above advantages at the same time.

It is a common practice with the bladeless type of cleaning system to press a brush roller or similar brush member against the image carrier and cause the former to rub the latter. In the case of a brush roller, the tips of bristles are pressed against the image carrier for scraping off the residual toner. Further, in the simultaneous developing and cleaning system, after the brush member, pressed against the image carrier, has rubbed the image carrier for weakening the adhesion of the residual toner to the image carrier, the developing device collects the residual toner, so that the residual toner can be easily collected.

However, the conventional bladeless type of cleaning system has a drawback that the bristles of the brush member, pressed against the image carrier, collapse and lose the expected function due to aging. Particularly, the role of the brush member is significant in the bladeless type of cleaning system as to the removal of residual toner, compared to the blade type of cleaning system. Therefore, the malfunction of the brush member ascribable to collapse adversely influences image quality more in the bladeless type of cleaning system than in the blade type of cleaning system.

The conventional bladeless type of cleaning system has another problem to be described hereinafter. Silica, zinc stearate and other additives contained in toner grains sometimes part from the toner grains due to, e.g., mechanical stresses acting during image formation. If such additives parted from the toner grains are pressed against the image carrier by a developer in a developing zone or by the brush member over a long time, then the additives adhere to the image carrier in the form of a thin film. This phenomenon is generally referred to as filming. Filming weakens the adhesion of the toner grains to the image carrier and thereby blurs or otherwise disfigures an image. Because the bladeless type of cleaning system rubs the image carrier with a weaker force than the blade type of cleaning system, as stated earlier, it cannot sufficiently shave off the film.

Generally, an image forming apparatus is developed with priority given to either one of image quality, i.e., the obviation of black stripes and the extension of the life of the image carrier and size reduction of the apparatus in accordance with the design object and desired characteristics of the apparatus. However, when priority is given to image quality, the life of the image carrier is short and needs frequent replacement. This not only obstructs efficient maintenance, but also increases user's expense. On the other hand, when priority is given to the life of the image carrier and size reduction, it is difficult to sufficiently reduce black stripes and therefore to enhance image quality.

Technologies relating to the present invention are also disclosed in, e.g., Japanese Patent Laid-Open Publication Nos. 8-137198, 8-137205, 9-211979, 11-190931, 2000-194242, 2000-242152, 2001-75448, 2001-117317 and 2001-356614.

SUMMARY OF THE INVENTION

It is a first object of the present invention to provide a small size, low cost, high image quality, cleaningless image forming apparatus capable of preventing, even when configured to allow residual toner on an image carrier to pass a position where the image carrier and a charging member contact each other, the residual toner from depositing on the charging member and lowering image quality, and a process cartridge for use in the same.

It is a second object of the present invention to provide an image forming apparatus capable of extending the life of an image carrier while sufficiently reducing black stripes, and a process cartridge for use in the same.

It is a third object of the present invention to provide an image forming apparatus capable of coping with the malfunction of a brush member ascribable to aging while making the most of the merits of the bladeless type of cleaning system, and a process cartridge for use in the same.

It is a fourth object of the present invention to provide an image forming apparatus capable of sufficiently reducing filming while making the most of the merits of the bladeless type of cleaning system.

An image forming apparatus of the present invention includes an image carrier. A charging device uniformly charges the surface of the image carrier with a charging member, which is applied with a bias of preselected polarity, contacting or adjoining the above surface. A latent image forming device forms a latent image on the surface of the image carrier thus uniformly charged. A developing device develops the latent image by depositing toner of the same polarity as the bias for charging on the latent image to thereby form a corresponding toner image. An image transferring device forms an electric field between the image carrier and a moving member whose surface is movable in contact with the image carrier to thereby transfer the toner image from the surface of the image carrier to a recording member or the moving member nipped between the image carrier and the moving member. A temporary holding device collects, among residual toner grains left on the surface of the image carrier after the transfer of the toner image, toner grains of opposite polarity charged to polarity opposite to the preselected polarity from the surface of the image carrier and then releases them to the above surface at preselected timing. A collecting device collects the toner grains of opposite polarity, moved away from a position where the surface of the image carrier and the charging member face each other, from the above surface. At least one of a charge control agent and organic fine grains is present on the surface of the individual toner grain.

BRIEF DESCRIPTION OF THE DRAWINGS

The above and other objects, features and advantages of the present invention will become more apparent from the following detailed description taken with the accompanying drawings in which:

FIG. 9 is a table listing numerical values in relation to a bias for image transfer;

FIG. 10 is a table listing the results of experiments conducted to determine the optimum mean circularity of toner;

FIGS. 11A and 11B schematically show the specific configuration of toner for describing shape coefficients SF-1 and SF-2;

FIG. 26 is a table listing the results of Experiment 2 conducted in the fourth embodiment; and FIG. 27 is a table listing the results of Experiment 3 conducted in the fourth embodiment.

DESCRIPTION OF THE PREFERRED EMBODIMENTS

Preferred embodiments of the present invention will be described hereinafter.

First Embodiment

Figure 1:
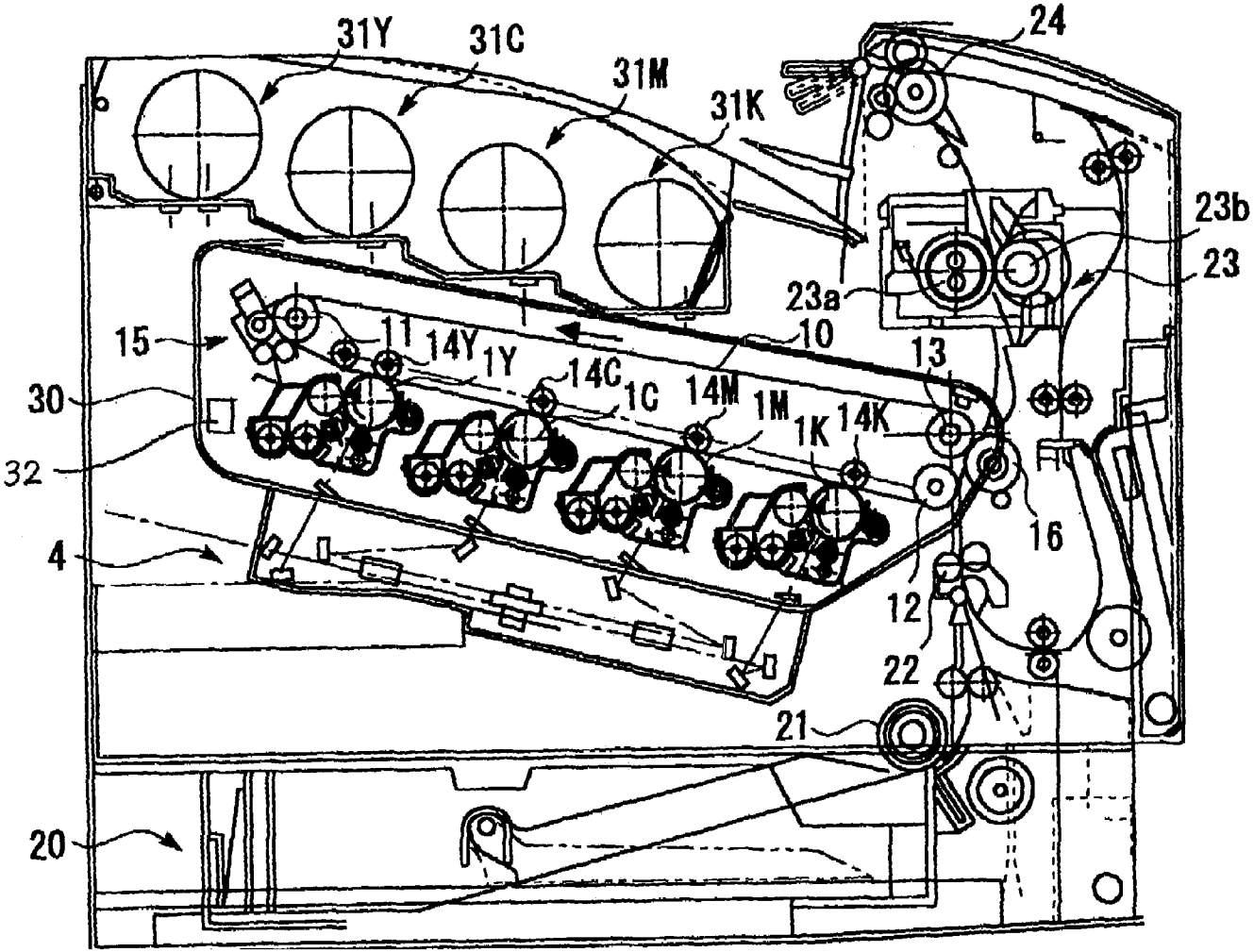
FIG. 1 is a view showing the general construction of a first embodiment of the image forming apparatus in accordance with the present invention.

Referring to FIG. 1 of the drawings, an image forming apparatus embodying the present invention and mainly directed toward the first object stated earlier is shown and implemented as an electrophotographic printer by way of example. As shown, the printer includes four photoconductive drums or image carriers 1Y (yellow), 1C (cyan), 1M (magenta) and 1K (black), which may be replaced with photoconductive belts, if desired. The drums 1Y through 1K rotate in a direction indicated by arrows while contacting an intermediate image transfer belt (simply belt hereinafter) 10. The drums 1Y through 1K each is made up of a hollow, cylindrical conductive base having relatively small wall thickness, a photoconductive layer formed on the base, and a protection layer formed on the photoconductive layer. In the illustrative embodiment, each drum has an outside diameter of 30 mm and an inside diameter of 28.5 mm. An intermediate layer may be formed between the photoconductive layer and the protection layer, if desired.

In the illustrative embodiment, the photoconductive layer may be implemented by an OPC (Organic PhotoConductor) in order to reduce cost, enhance free design, and obviate environmental pollution. Polyvinyl carbazole or similar photoconductive resin is a typical OPC. Further, OPCs are generally classified into PVK-TNF (2,4,7-trinitrofluorenone) and other charge transfer complex type of OPCs, phthalocyanine binder and other pigment dispersion type of OPCs, split-function type of OPCs each consisting of a charge generating substance and a charge transporting substance. Among them, split-function type of OPCs are attracting increasing attention today.

Figure 2:
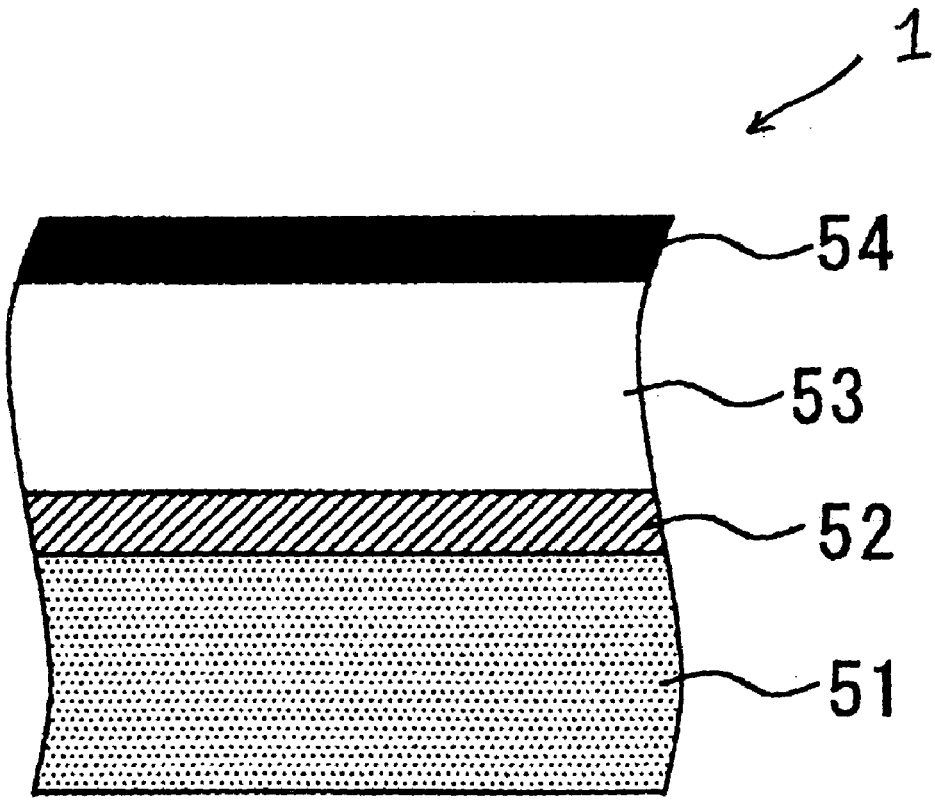
FIG. 2 is a section showing the configuration of a photoconductive drum or image carrier included in the first embodiment.

FIG. 2 is a section showing the structure of any one of the drums 1Y through 1K used in the illustrative embodiment. As shown, the drum, labeled 1, is a split-function type of photoconductive element and made up of a conductive base 51, a charge generating layer 52 formed on the base 51, a charge transporting layer 53 formed on the charge generating layer 52, and a protection layer 54 formed on the charge transporting layer 53. A latent image is formed on the drum 1 by the following mechanism.

When the drum 1 is charged and then illuminated by imagewise light, the light propagates through the transparent charge transporting layer 53 and is then absorbed by the charge generating substance of the charge generating layer 52. The charge generating substance then generates charge carriers and injects them in the charge transporting layer 53. The charge carriers migrate through the charge transporting layer 53 to thereby neutralize the charge of the surface of the drum 1. The neutralized portion of the drum 1 becomes a latent image. Such a split-function type of photoconductor should preferably be the combination of a charge transporting substance absorbing mainly ultraviolet rays and a charge transporting substance absorbing mainly visible rays.

However, the problem with an OPC is that it lacks mechanical and chemical durability. More specifically, while many of charge transporting substances are developed as low molecular weight compounds, the compounds each are usually dispersed in or mixed with an inactive polymer because it cannot form a film alone. Generally, a low molecular weight compound or charge transporting substance and a charge transporting layer, which is implemented by an inactive polymer, are soft and lack mechanical durability. Therefore, when the drum 1 with the charge transporting layer is repeatedly used, the layer is easily shaved by the developer, belt 10 and a brush roller 41. It is therefore preferable to form the protection layer 54 in order to extend the life of the drum 1.

Materials applicable to the protective layer 54 include ABS resin, ACS resin, olefine-vinylmonomer copolymer, chlorinated polyether resin, allyl resin, phenol resin, polyacetal resin, polyamide resin, polyamide-imide resin, polyacrylate resin, polyallyl sulfonic resin, polybutylene resin, polybutylene terephthalate resin, polycarbonate resin, polyether sulfonic resin, polyethylene resin, polyethylene terephthalate resin, polyimide resin, acrylic resin, polymethylpentene resin, polypropylene resin, polyphenyleneoxide resin, polysulfonic resin, AS resin, AB resin, BS resin, polyurethane resin, polyvinyl chloride resin, polyvinylidene chloride resin, and epoxy resin.

A filler may be added to the protection layer 54 for improving abrasion resistance. The filler may be any one of polytetrafluoroethylene or similar fluorocarbon resin or silicone resin with or without titanium oxide, tin oxide, potassium titanate, silica, alumina or similar inorganic material being dispersed therein. The content of the filler should be 10 wt. % to 40 wt. %, more preferably 20 wt. % to 30 wt. %. A filler content less than 10 wt. % is apt to make abrasion resistance short, depending on arrangements around the drum 1 relating to the shaving of the drum 1. A filler content higher than 40 wt. % is apt to lower sensitivity to exposure. A dispersion aid may be added for improving the dispersiveness of the filler, if desired. For the dispersion aid, use may be made of any one of dispersion aids customary with, e.g., paints. The amount of the dispersion aid should be 0.5% or above, but 4.0% or below, of the filler content or above in terms of weight, preferably 1% or above, but 2% or below. Addition of a charge transporting material to the protective layer 54 is also effective. An antioxidant may also be added, if necessary.

To form the protection layer 54, any one of conventional methods, including dip coating, spray coating, beat coating, nozzle coating, spinner coating and ring coating, may be used. The thickness of the protection layer is between 0.5 μm and 10 μm, preferably between 4 μm and 6 μm.

The intermediate layer, which may be formed between the photoconductive layer made up of the charge generating layer 52 and charge transporting layer 53 and the protection layer 54, consists mainly of binder resin. The binder resin may be any one of polyamide, alcohol-soluble nylon, water-soluble polyvinyl butyral, polyvinyl butyral, polyvinyl alcohol, and so forth. Any one of conventional coating methods may be used to form the intermediate layer. The thickness of the intermediate layer should preferably be between 0.05 μm and 2 μm.

Figure 3:
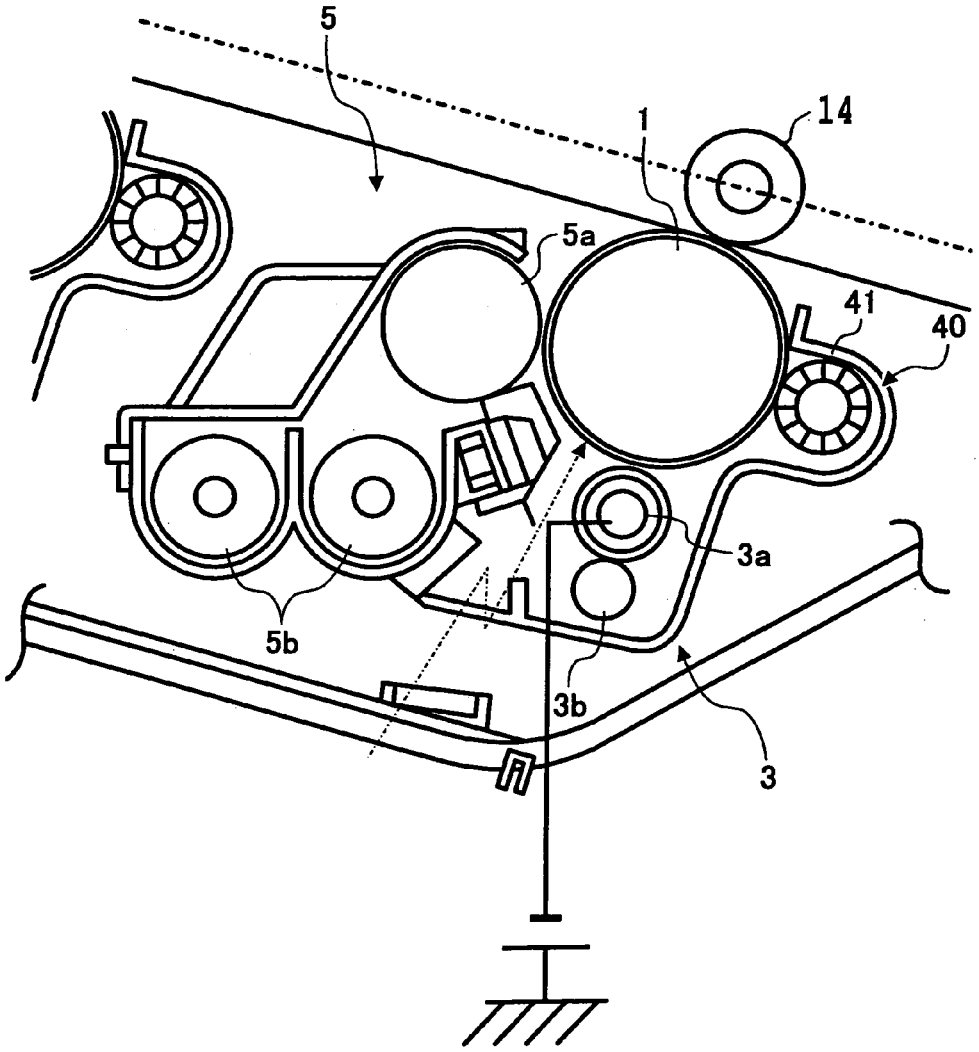
FIG. 3 is a view showing arrangements around the drum.

FIG. 3 shows arrangements around the drum 1. It is to be noted that arrangements around the drums 1Y through 1K are identical with each other and distinguished from each other by suffices Y through K. As shown, a toner holding device or temporary toner holding means 40, a charging device or charging means 3 and a developing device or developing means 5 are sequentially arranged around the drum 1 in this order in the direction in which the surface of the drum 1 moves. A space for allowing a light beam, issuing from the exposing unit or latent image forming means 4 and represented by an arrow, to pass exists between the charging device 3 and the developing device 5.

The charging device 3 uniformly charges the surface of the drum 1 to negative polarity. In the illustrative embodiment, the charging device 3 includes a charge roller or charging member 3*a* that performs contact or vicinity type of charging. More specifically, the charge roller 3*a* contacts or adjoins the surface of the drum 1 and applied with a negative bias for uniformly charging the drum 1. In the illustrative embodiment, a DC bias is applied to the drum 1 such that the surface of the drum 1 is uniformly charged to −500 V. The DC bias may be replaced with an AC-biased DC bias, if desired. The AC-biased DC bias, however, needs an exclusive AC power supply and therefore makes the apparatus bulky.

The charging device 3 additionally includes a cleaning brush 3*b* for cleaning the surface of the charge roller 3*a*. In the illustrative embodiment, toner deposits on the charge roller 3*a* little, as will be described later specifically. However, any toner deposited on the charge roller 3*a* would bring about irregular charging or similar defective charging. This is why the cleaning brush 3*b* cleans the surface of the charge roller 3*a*.

If desired, thin films may be wrapped around the axially opposite end portions of the charge roller 3*a* and held in contact with the drum 1. In such a case, the surface of the charge roller 3*a* is extremely close to the surface of the drum 1, but spaced by the thickness of the films. In this condition, the bias applied to the charge roller 3*a* causes discharge to occur between the charge roller 3*a* and the drum 1 for thereby uniformly charging the drum 1.

The exposing unit 4 scans the charged surface of the drum 1 with a light beam in accordance with color-by-color image data, thereby sequentially forming latent images of different colors on the drum 1. While the exposing unit 4 uses a laser in the illustrative embodiment, use may alternatively be made of an exposing unit including an LED (Light Emitting Diode) array and focusing means.

The developing device 5 includes a casing accommodating a developing roller or developer carrier 5*a*. The developing roller 5*a* is partly exposed to the outside via an opening formed in the casing. The illustrative embodiment uses a two-component type developer made up of toner grains and carrier grains although it is similarly practicable with a single-component type developer, i.e., toner grains. More specifically, the developing device 5 stores toner replenished from corresponding one of toner bottles 31Y through 31K, which are individually removably mounted to the printer body. When any one of the toner bottles 31Y through 31K runs out of toner, it should only be replaced alone, successfully reducing running cost.

The toner replenished from any one of the toner bottles 31Y through 31K to the developing device 5 is conveyed by a screw 5*b* while being agitated together with carrier grains and is then deposited on the developing roller 5*a*. The developing roller 5*a* is made up of a stationary magnet roller or magnetic field generating means and a sleeve rotatable about the axis of the magnet roller. The carrier grains of the developer are caused to rise on the sleeve in the form of brush chains by the magnetic force of the magnet roller and are conveyed by the sleeve to a developing zone where the sleeve and drum 1 face each other. The developing roller 5*a* rotates at a higher linear velocity than the drum 1. The brush chains on the developing roller 5*a* feed the toner grains deposited thereon to the drum 1 while rubbing the surface of the drum 1.

A power supply, not shown, applies a bias of −300 V for development to the developing roller 5*a*, forming an electric field in the developing zone. In this condition, an electrostatic force, directed toward the latent image on the drum 1, acts on the toner grains between the latent image and the developing roller 5*a*, causing the toner grains to deposit on the latent image and develop the latent image. The toner grains of expected or regular polarity, left on the drum 1 after the image transfer, are collected in the developing device 5.

The belt 10 is passed over three rollers 11, 12 and 13 and caused to move in a direction indicated by an arrow in FIG. 1. Toner images of different colors are sequentially, electrostatically transferred from the drums 1Y through 1K to the belt 10 one above the other. While electrostatic image transfer may be implemented by a charger, the illustrative embodiment uses image transfer rollers 14Y through 14K because they reduce toner scattering.

More specifically, the image transfer rollers or primary image transferring means 14Y through 14K are held in contact with the inner surface of the loop of the belt 10 while facing the drums 1Y through 1K, respectively. The portions of the belt 10 pressed by the image transfer rollers 14Y through 14K and drums 1Y through 1K form nips for primary image transfer. A positive bias is applied to each of the image transfer rollers 14Y through 14K when a toner image is to be transferred from associated one of the drums 1Y through 1K to the belt 10. As a result, an electric field for image transfer is formed in each nip and electrostatically transfers the toner image from the drum to the belt 10.

A belt cleaner 10 adjoins the belt 10 for removing the toner left on the belt 10 and includes a fur brush and a cleaning blade. The fur brush and cleaning blade collect the toner left on the belt 10 after image transfer. The toner thus collected is conveyed from the belt cleaner 15 to a waste toner tank, not shown, by conveying means not shown.

A secondary image transfer roller 16 is held in contact with part of the belt 10 passed over the roller 13, forming a nip for secondary image transfer therebetween. A sheet or recording medium is fed from a sheet cassette 20 to the above nip by a pickup roller 21 and a roller pair 22 at preselected timing. A composite toner image formed on the belt 10 is transferred from the belt 10 to the sheet at the nip for secondary image transfer. More specifically, a positive bias is applied to the secondary image transfer roller 16, forming an electric field for transferring the toner image from the belt 10 to the sheet.

A fixing unit or fixing means 23 is positioned downstream of the secondary image transfer nip in the direction of sheet conveyance. The fixing unit 23 includes a heat roller 23, which accommodates a heater therein, and a press roller pressed against the heat roller 23. The heat roller 23 and press roller 23 nip the sheet and fix the toner image on the sheet with heat and pressure. The sheet with the toner image thus fixed is driven out to a stack tray positioned on the top of the printer body by an outlet roller pair 24.

In the illustrative embodiment, the drums 1Y through 1K, developing devices and other parts arranged around the drums 1Y through 1K, exposing unit 4, belt 10 and belt cleaning device 15 are constructed into a single process cartridge 30, which is removably mounted to the printer body. The process cartridge 30 can therefore be replaced when the life of any one of constituents thereof ends or the constituent needs maintenance. In the illustrative embodiments, the toner bottles 31Y through 31K each are removable from the printer body independently of the process cartridge 30.

Now, the toner grains left on the drum 1 after image transfer contain toner grains charged to the regular or expected polarity and toner grains charged to the opposite polarity. Assume that the contact or vicinity type of charging system is applied to an image forming apparatus of the type uniformly charging the drum 1 to the same polarity as the toner, i.e., regular polarity. Then, the toner grains of opposite polarity electrostatically deposit on the charge roller 3*a* and obstruct the uniform charging of the drum 1, resulting in the degradation of image quality stated earlier.

On the other hand, the toner grains of regular polarity, which is identical with the polarity of the bias applied to the charge roller 3*a*, do not deposit on the charge roller 3*a*. Moreover, the toner grains of regular polarity deposit on the carrier grains present on the developing roller 5*a* and are collected thereby or constitute the toner image in the image forming step. These toner grains therefore have little influence on the image forming step.

Figure 4A:
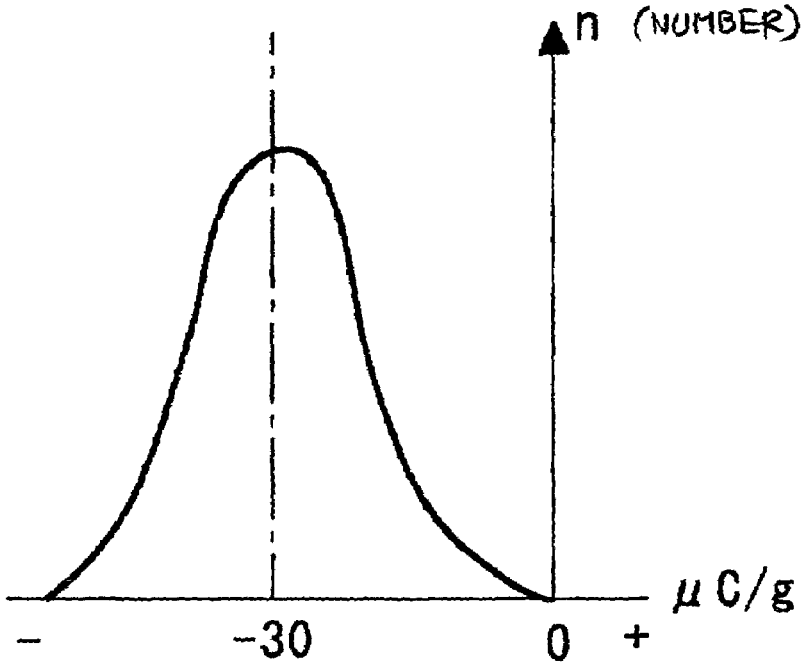
FIG. 4A is a graph showing the charge potential distribution of toner present on the drum just before image transfer.
Figure 4B:
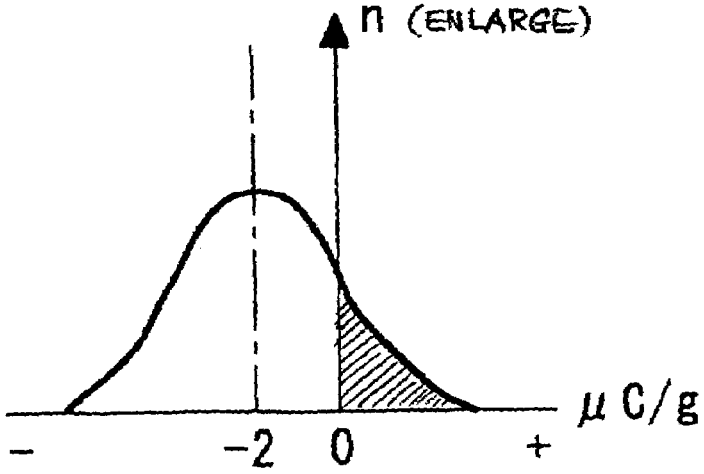
FIG. 4B is a graph showing the charge potential distribution of the toner after image transfer.

FIG. 4A is a graph showing the charge potential distribution of the toner grains just before the transfer from the drum 1. FIG. 4B is a graph showing the charge potential distribution of the toner grains left on the drum 1 after the transfer from the drum 1. As shown in FIG. 4A, the amount of charge just before the transfer is distributed at both sides of substantially −30 μC/g; most of the toner grains are charged to negative or regular polarity. As shown in FIG. 4B, the amount of charge left on the drum 1 after the transfer is distributed at both sides of substantially −2 μC/g. Generally, most of the toner grains left on the drum 1 after the transfer are defective grains unable to be charged to the expected polarity due to, e.g., defective composition. Therefore, part of the residual toner grains is charged to positive polarity due to, e.g., charge injection ascribable to the positive bias applied to the primary image transfer roller 14. This is why toner grains of opposite polarity exist, as indicated by a hatched portion in FIG. 4B.

If the toner grains of opposite polarity are conveyed by the drum 1 to the position where the drum 1 faces the charge roller 3*a*, which is applied with the positive bias, then they are electrostatically attracted by and deposited on the charge roller 3*a*. This is also true with the configuration in which the charge roller 3*a* adjoins the drum 1 as stated above. The toner grains so deposited on the charge roller 3*a* cause the resistance and surface condition of the charge roller 3*a* to vary, so that charge start voltage between the charge roller 3*a* and the drum 1 becomes irregular. As a result, even if the same bias as when the toner grains of opposite polarity are absent on the charge roller 3*a* is applied, the drum 1 cannot be uniformly charged to the desired potential of −500 V. This is apt to bring about irregular image density as well.

Further, when the toner grains deposit on only part of the charge roller 3*a*, then the current derived from the charge bias concentrates on the other part of the charge roller 3*a* where such toner grains are absent. Therefore, if the same bias as when the toner grains of opposite polarity are absent is applied, then the charge potential of the drum 1 rises above the desired potential. Consequently, the potential of the latent image portion, which is formed by the exposing unit 4, is shifted to the negative side, lowering image density.

Moreover, when the toner grains deposit on substantially the entire charge roller 3*a* in such a manner as to coat the charge roller 3*a*, the charging ability of the charge roller 3*a* is lowered with the result that the surface potential of the drum 1 is lowered below the desired potential. Consequently, the potential of the portion of the drum 1 not scanned by the exposing unit 4, i.e., the background portion approaches the bias applied to the developing roller 5*a*. This causes toner grains with short charge to deposit on the background of the drum, thereby bringing about background contamination.

On the other hand, the residual toner grains on the drum 1 contain toner grains of negative or regular polarity as well. Such negative toner grains, however, do not deposit on the charge roller 3*a* even when conveyed to the position where the charge roller 3*a* and drum 1 face each other so long as the bias is applied to the charge roller 3*a*. Moreover, such toner grains have little influence on the image forming step, as stated previously. It is therefore important to prevent the toner grains of opposite polarity, existing in the residual toner grains, from adversely effecting the image forming step.

In light of the above, the illustrative embodiment removes, before the residual toner on the drum 1 reaches the position where the drum 1 and charge roller 3*a* face each other, the toner of negative polarity with the temporary holding means.

The removal of the toner of opposite polarity from the drum 1, which characterizes the illustrative embodiment, will be described specifically hereinafter. First, reference will be made to FIG. 5 for describing the configuration and operation of the toner holding device or temporary toner holding means 40. As shown, the toner holding device 40 includes a brush roller 41 held in contact with the drum 1. The brush roller 41 is provided with relatively low brush density so as to have a space large enough to accommodate toner grains of opposite polarity $T_1$. This not only reduces the frequency of release of the toner grains $T_1$, which will be described later, but also reduces mechanical restraint to act on the toner grains T1 held by the brush roller 41 for thereby promoting smooth release of the toner grains $T_1$. In the illustrative embodiment, density around the surface of the brush roller 41 is selected to be between 12,000 bristles/inch$^2$ and 858,000 bristles/inch$^2$. Also, the bristles are 3 mm long, as measured from the shaft of the brush roller 41, and provided with a Young's modulus of 30 cN/dtex.

Figure 5:
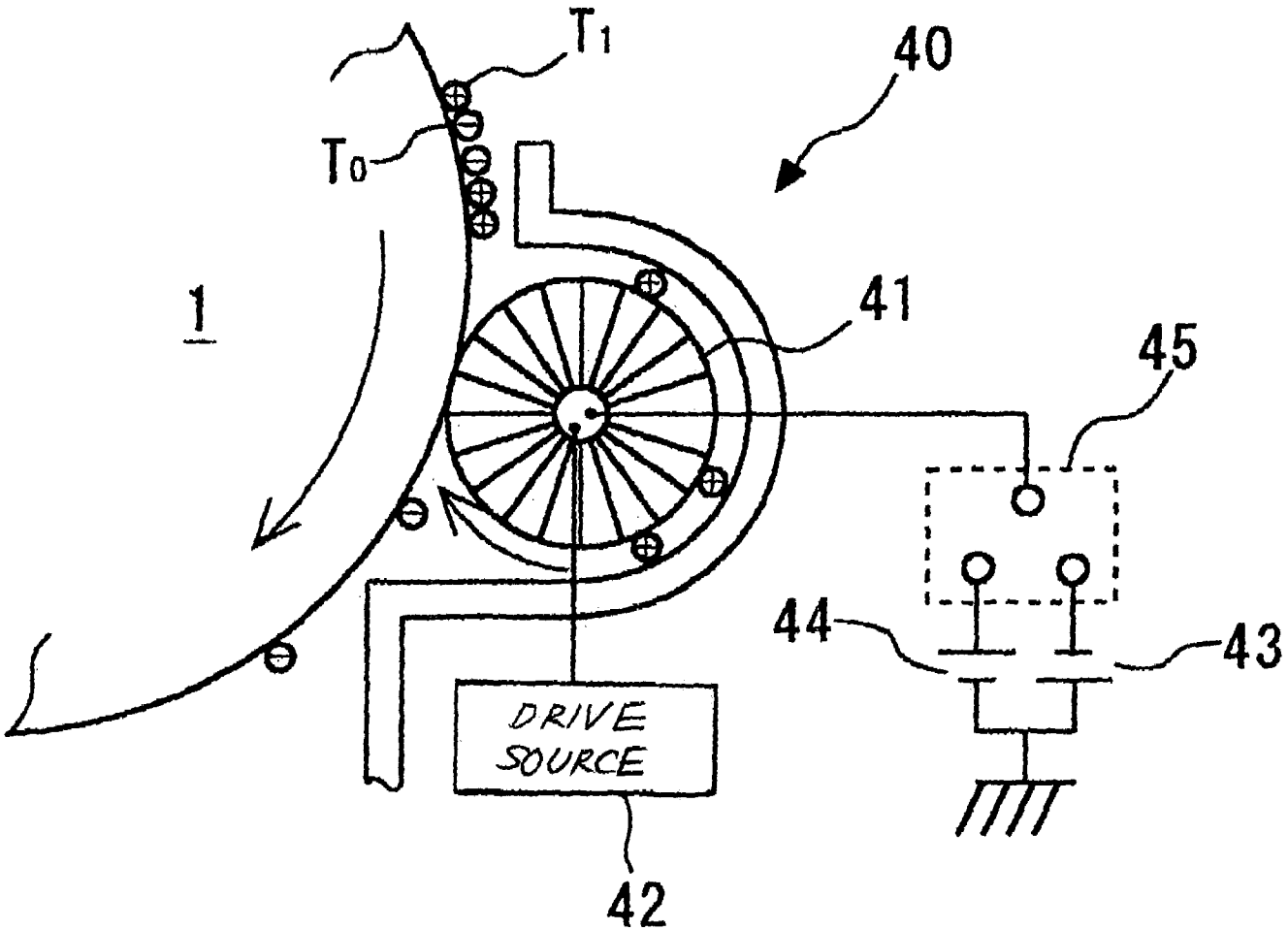
FIG. 5 is a view showing a toner holding device included in the first embodiment.

A drive source 42 causes the brush roller 41 to rotate in a direction indicated by an arrow in FIG. 5. A first and a second power supply 43 and 44 selectively apply a bias to the brush roller 41 via a switch 45. The switch 45 is controlled by a controller, not shown, included in the illustrative embodiment. The first and second power supplies 43 and 44 respectively apply a hold bias that deposits a potential of −700 V on the brush roller 41 and a release bias that deposits a potential of +200 V on the same. The hold bias causes the brush roller 41 to hold the toner grains of opposite polarity $T_1$ while the release bias causes the former to release the latter. While the power supplies 43 and 44 are implemented as DC power supplies in the illustrative embodiment, they may alternatively be implemented as AC-biased DC power supplies, if desired.

Before part of the drum 1 where the residual toner grains are deposited reaches a zone where the drum 1 and brush roller 41 contact each other (brush contact zone hereinafter), the first power supply 43 starts applying the hold bias to the brush roller 41 via the switch 45. In this condition, on contacting the drum 1, the brush roller 41 causes the toner grains of opposite polarity $T_1$ to deposit on the brush roller 41 for thereby holding them.

More specifically, the drum 1, uniformly charged to −500 V by the charging device 3, is scanned by the exposing unit 4 with the result that the potential of the latent image portion is varied to about −50 V. After the developing step and image transferring step following the above scanning step, the potential of the latent image portion is brought closer to 0 V. Most of the residual toner grains on the drum 1 are present in the portion where the latent image was present. Therefore, in the brush contact zone, the toner grains $T_1$ present on such a portion of the drum 1 are subject to an electrostatic force extending toward the brush roller 41, which is applied with the bias of −700 V. The background portion of the drum 1 where the potential is −500 V is also subject to the image transferring step, so that the potential is shifted toward the 0 V side. While a small amount of residual toner sometimes deposits on the background portion, the above electrostatic force acts on such toner grains $T_1$ also. Consequently, the toner grains $T_1$, included in the residual toner grains on the drum 1, are deposited on and held by the brush roller in the brush contact zone.

On the other hand, the toner grains of negative or regular polarity $T_0$, also included in the residual toner grains on the drum 1, are subject to an electrostatic force extending toward the drum 1 in the brush contact zone. The toner grains $T_0$ therefore remain on the drum 1 without being transferred to the brush roller 41. The toner grains $T_0$, conveyed via the brush contact zone by the drum 1, do not adversely effect the image transferring step, as stated earlier, but simply form the next toner image or are collected by the developing device 5.

In the illustrative embodiment, the brush roller 41 is rotated in the opposite direction to the drum 1, i.e., in the counter direction in the brush contact region, so that a number of bristles can rub the surface of the drum 1 with their tips. Because the illustrative embodiment uses spherical toner grains, filming is likely to occur due to aging although the amount of residual toner is relatively small because of high image transfer efficiency. In the illustrative embodiment, the brush roller 41 rubs the surface of the drum 1 to thereby scatter the toner grains $T_0$ of regular polarity present on the drum 1. This successfully weakens the adhesion of the toner grains $T_0$ to the drum 1 and therefore promotes easy collection of the toner grains $T_0$ moved away from the brush contact zone by the developing device 5.

The above advantage is achievable even when the brush roller 41 is moved in the same direction as the drum 1 in the brush contact zone if a linear velocity difference is established therebetween. Further, such movement of the brush roller 41 reduces load torque to act on the drive sources assigned to the brush roller 41 and drum 1, compared to the counter movement of the brush roller 41 stated above. In addition, a decrease in the load torque to act on the drive source assigned to the drum 1 reduces banding for thereby insuring stable, high quality images.

In the illustrative embodiment, a cleaning blade contacting the drum 1 is absent. This further reduces the load torque to act on the drive source assigned to the drum 1. Although the absence of a cleaning blade may lower the cleaning ability and bring about filming, the illustrative embodiment obviates filming by allowing the developing device 5 to efficiently collect the toner grains $T_0$, as stated previously.

The tips of the bristles, constituting the brush roller 41, jump up when they part from the surface of the drum 1 and are therefor likely to scatter the toner grains. If the brush roller 41 is moved in the same direction as the drum 1 in the brush contact zone, then the toner grains so scattered fly toward the downstream side of the brush contact zone in the direction of movement of the drum 1. Should such toner grains be of opposite polarity, then they would deposit on the charge roller 3*a* and bring about defective charging. By contrast, when the brush roller 41 is moved in the counter direction as in the illustrative embodiment, the toner grains scattered fly toward the upstream side of the brush contact zone in the direction of movement of the drum 1 and do not deposit on the charge roller 3*a*.

As stated above, the illustrative embodiment makes it needless to assign an exclusive cleaning device to each of the drums 1Y through 1K. This, coupled with the fact that the toner holding device 40 has only to temporarily hold the toner grains of opposite polarity $T_1$, makes the cleaning device far smaller in size than the conventional cleaning device.

Hereinafter will be described how the brush roller 41 is caused to release the toner grains T1 to the surface of the drum 1. In the illustrative embodiment, the brush roller 41, holding the toner grains of opposite polarity $T_1$, releases or returns them to the surface of the drum 1 at a preselected time when image formation is not under way. While this timing is open to choice, the release of the toner grains $T_1$ may be effected one time for every fifty times of image formation.

More specifically, after holding all the toner grains $T_1$ derived from one image forming step, the brush roller 41 releases them before part of the drum 1 to be uniformly charged by the charging device 3 during the next image forming step arrives at the brush contact zone. This allows the toner grains $T_1$ to be collected by the developing device 5 without adversely effecting the next image forming step. It is to be noted that in a repeat print mode, the brush roller 41 may release the toner grains $T_1$ consecutively deposited thereon after the last image forming step, in which case the image forming time is prevented from extending due to the collection of the toner grains $T_1$ to be described later.

The release of the toner grains $T_1$ will be described more specifically hereinafter. The potential left after the preceding image forming step exists on part of the surface of the drum 1 to which the toner grains $T_1$ are expected to deposit at the timing stated above. In the illustrative embodiment, the residual potential is about −50 V. When the second power supply 44 applies the release bias to the brush roller 41 via the switch 45, the potential of +200 V is deposited on the brush roller 41 with the result that an electrostatic force, directed toward the drum 1 whose surface potential is −50 V, acts on the toner grains $T_1$. Consequently, the toner grains $T_1$ are released from the brush roller 41 and deposited on the drum 1.

The collection of the toner grains $T_1$ again transferred from the brush roller 41 to the drum 1 will be described hereinafter. In the illustrative embodiment, before the toner grains $T_1$ again deposited on the drum 1 reach a position where they contact the charge roller 3*a*, the application of the bias to the charge roller 3*a* is interrupted by the controller. In this sense, the controller plays the role of bias interrupting means. As a result, the charge roller 3*a* is grounded with the result that the surface potential of the charge roller 3*a* becomes substantially 0 V. On the other hand, because the surface potential of the drum 1 on which the toner grains $T_1$ are present is about −50 V, as stated previously, an electrostatic force, directed toward the drum 1, acts on the toner grains $T_1$ at the contact position of the drum 1 and charge roller 3*a*. Consequently, the toner grains $T_1$ can pass the contact position without depositing on the charge roller 3*a*.

Figure 6:
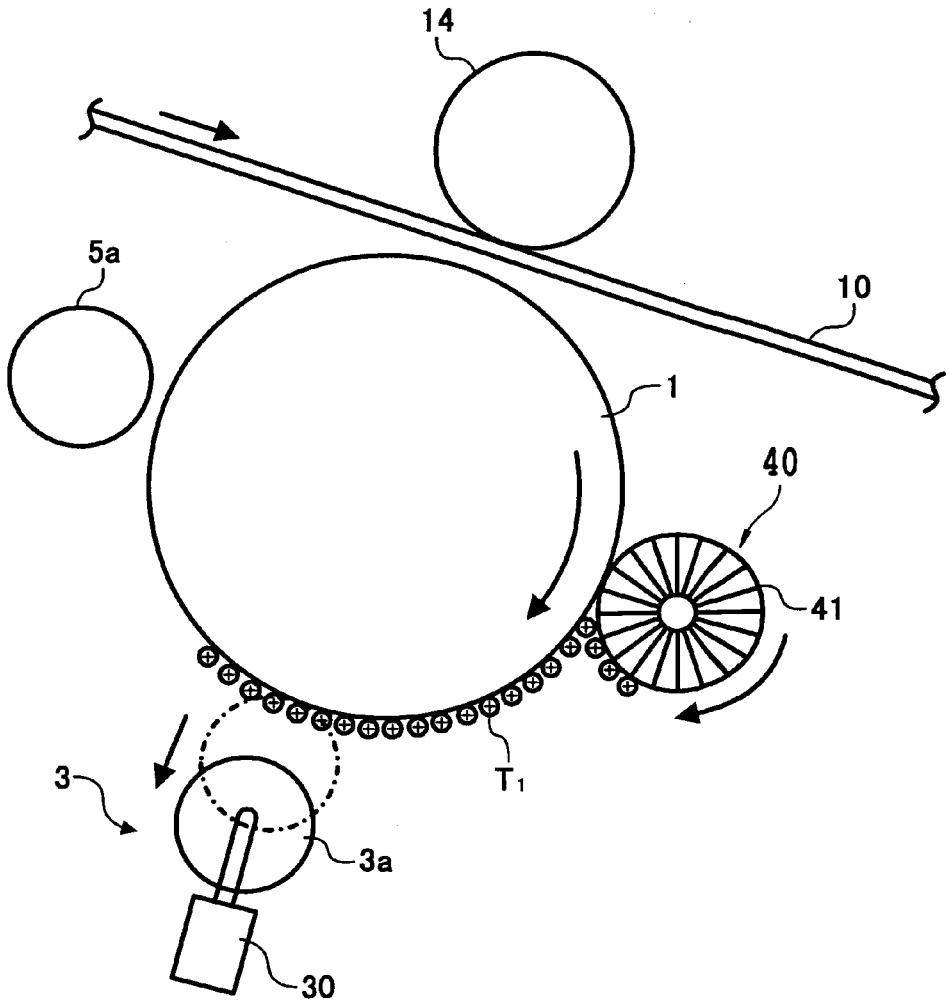
FIG. 6 is a view showing a charging device included in the first embodiment and provided with releasing means.

In the case of the contact type of charging system, the charging device 3 should preferably be provided with releasing means for selectively releasing the charge roller 3*a* from the drum 1, as will be described with reference to FIG. 6. As shown, a releasing mechanism or releasing means 30 is configured to release the charge roller 3*a* from the drum 1 before the toner grains $T_1$, transferred from the brush roller 41 to the drum 1, reaches the position where they contact the charge roller 3*a*. The releasing mechanism 30 may have any one of conventional configurations. When the charge roller 3*a* is released from the drum 1, the toner grains $T_1$ can pass the position where they face the charge roller 3*a* without contacting or depositing on the charge roller 3*a*. This obviates the variation of the charge start voltage between the charge roller 3*a* and the drum 1 that would lower image density, bring about background contamination or irregular image quality.

The toner grains $T_1$ moved away from the position where they contact the charge roller 3*a* are conveyed to the developing zone. The illustrative embodiment interrupts the application of the bias to the developing roller 5*a* as well before the toner grains $T_1$ on the drum reach the developing zone. As a result, the developing roller 5*a* is grounded with the result that the surface potential of the developing roller 5*a* becomes substantially 0 V. On the other hand, because the surface potential of the drum 1 on which the toner grains $T_1$ are present is about −50 V, as stated previously, an electrostatic force, directed toward the drum 1, acts on the toner grains $T_1$ in the developing zone. Consequently, the toner grains $T_1$ can pass the developing zone without depositing on the developing roller 5*a*.

Figure 7:
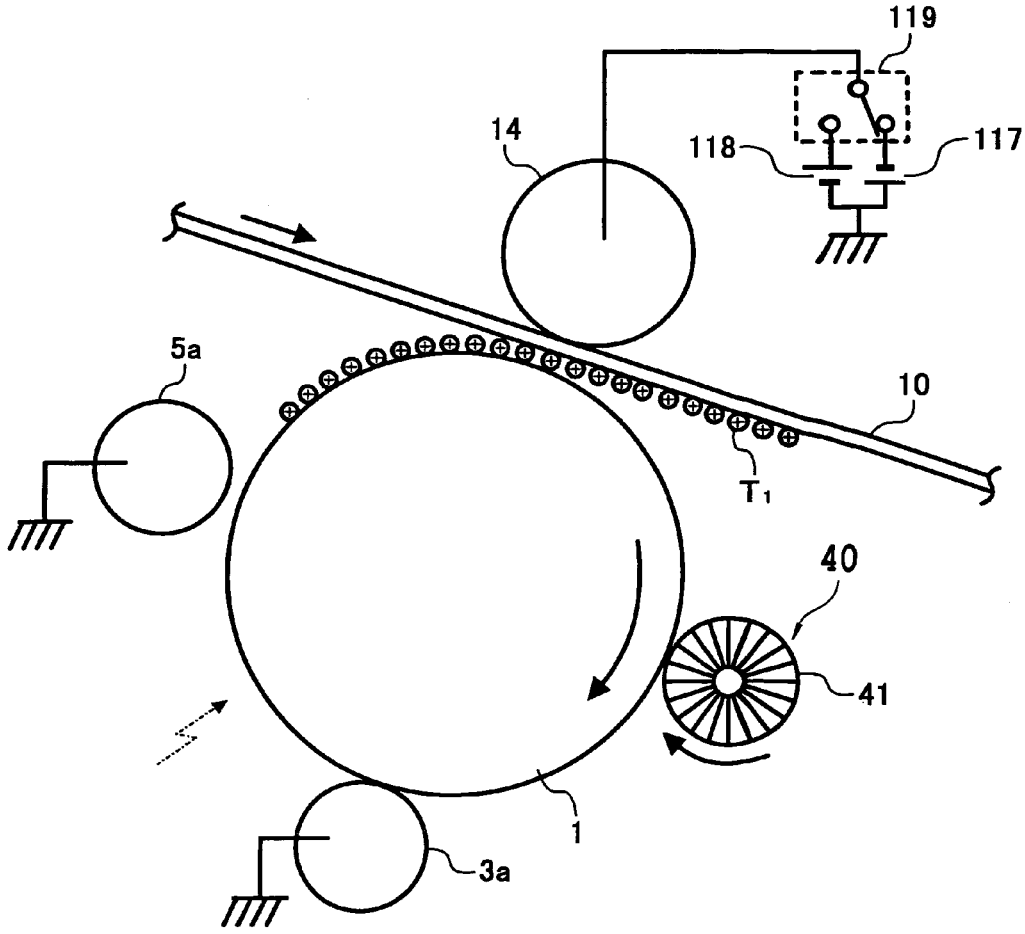
FIG. 7 is a view showing a nip for primary image transfer included in the first embodiment.

As shown in FIG. 7, The toner grains $T_1$ moved away from the developing zone are conveyed to the primary image transfer nip where they contact the belt 10. The illustrative embodiment applies a bias opposite in polarity to the bias for image formation to the primary image transfer roller 14 before the toner grains $T_1$ on the drum 1 arrive at the primary image transfer nip. More specifically, as shown in FIG. 7, a first and a second image transfer power supply 117 and 118 selectively apply a bias to the primary image transfer roller 14 via a switch 119 under the control of the controller.

The first power supply 117 applies a bias of −300 V while the second power supply 118 applies a bias that differs from one of the primary image transfer rollers 14Y through 14K to another and lies in the range of from +400 V to +2,000 V. The second power supply 118 is connected to the primary image transfer roller 14 in the event of image transfer while the first power supply 118 is connected to the same in the event of collection of the toner grains $T_1$ from the drum 1.

The negative bias, applied to the primary image transfer roller 14 in the event of collection, forms an electric field between the surface of the drum 1 (−50 V) on which the toner grains $T_1$ are present and the belt 10. The electric field causes an electrostatic force directed toward the belt 10 to act on the tone grains $T_1$, thereby transferring the toner grains $T_1$ from the drum 1 to the belt 10. Subsequently, the toner grains on the belt 10 are conveyed to the secondary image transfer nip between the belt 10 and the secondary image transfer roller 16. Before the toner grains $T_1$ arrive at the above nip, the bias for image transfer for usual image transfer, i.e., a positive bias is applied to the secondary image transfer roller 16. Because the surface potential of the belt 10, carrying the toner grains $T_1$, is substantially 0 V at the nip, an electrostatic force, directed toward the belt 10, acts on the toner grains T1 at the nip. Consequently, the toner grains $T_1$ are allowed to pass the nip without depositing on the secondary image transfer roller 16.

Alternatively, when the toner grains $T_1$ pass the secondary image transfer nip, the secondary image transfer roller 16 may be released from the belt 10.

The toner grains $T_1$ thus moved away from the secondary image transfer nip are conveyed to a cleaning zone where they face the belt cleaner 15. In the cleaning zone, the toner grains $T_1$ are scattered by the fur brush and then scraped off by the cleaning blade. In this manner, the toner grains $T_1$ on the belt 10 are collected by the belt cleaner 15.

The illustrative embodiment causes the belt cleaner to collect the toner grains $T_1$ from the belt 10, as stated above. Alternatively, before the toner grains $T_1$ on the belt 10 arrive at the secondary image transfer nip, a bias opposite in polarity to the bias assigned image formation may be applied to the secondary image transfer roller 16 so as to cause the roller 16 to collect the toner grains $T_1$. This alternative arrangement needs cleaning means for cleaning the surface of the secondary image transfer roller. Further, the toner grains $T_1$ may be collected by the sheet.

As stated above, in the illustrative embodiment, the toner grains $T_1$ released from the brush roller 41 are collected by way of the belt 10. This makes it needless to provide a waste toner tank for storing the toner grains $T_1$ for thereby implementing size reduction. Particularly, because the illustrative embodiment is a tandem printer including four drums 1Y through 1K, the size reduction is noticeable, compared to the conventional printer in which a particular waste toner tank is assigned to each drum.

The developing device 5 may be so configured as to collect the toner grains $T_1$, as will be described hereinafter. In this case, it is preferable to provide the developing device 5 with a clutch and interrupt the rotation of the developing roller 5*a* via the clutch when the toner grains $T_1$ on the drum 1 arrive at the developing zone. This prevents the toner in the developing device 5 from depositing on the drum 1 and being wastefully consumed thereby. Further, before the toner grains $T_1$ on the drum 1 arrive at the developing zone, a bias identical with the bias for image formation, i.e., −300 V is applied to the developing roller 5*a*, which plays the role of collecting means. In this condition, an electrostatic force, directed toward the developing roller 5*a*, acts on the toner grains $T_1$ between the drum 1 (−50 V) and the developing roller 5*a*, causing the toner grains $T_1$ to deposit on the developing roller 5*a*. Subsequently, when the developing roller 5*a* starts rotating at the time of image formation, the toner grains $T_1$ are conveyed to the inside of the developing device 5 by the developing roller 5*a*. The toner grains $T_1$ are then agitated in the developing device 5 and thereby charged to the regular polarity and again contribute to development.

By causing the developing roller 5*a* to collect the toner grains $T_1$, it is possible to render a toner recycling system and the size reduction of the printer compatible with each other.

The toner grains $T_1$ may be collected by both of the belt 10 and developing device 5, so that part of the toner grains $T_1$, moved away from the developing zone without being collected by the developing device 5, can be collected by the belt 10 at the primary image transfer nip. This further enhances sure collection of the toner grains $T_1$. In addition, even when the brush roller 41 releases a large amount of toner grains $T_1$ at a time, the toner grains $T_1$ can be sufficiently collected. Consequently, the frequency of release of the toner grains $T_1$ from the brush roller 41 can be reduced.

While the illustrative embodiment is implemented as a cleaningless image forming apparatus, the toner grains of regular or negative polarity may be collected by either one of the developing device 5 and belt 10 by any conventional technology.

When the toner grains $T_1$ exist in the drum 1 in a large amount when image formation is interrupted due to, e.g., a jam, the illustrative embodiment, lacking a cleaning blade for the drum 1, cannot easily collect the toner grains $T_1$ from the drum 1. In the illustrative embodiment, after a jam, for example, has been settled, the toner grains $T_1$ are transferred to the belt 10 in the same manner as during usual image formation and then collected by the belt cleaner 15. The belt cleaner 15 can collect even a large amount of toner grains $T_1$ because it includes the fur brush and cleaning blade. Part of the toner grains $T_1$, which may be left on the drum 1 even after the transfer to the belt 10, are dealt with in the same manner as during usual image formation.

The toner applicable to the illustrative embodiment will be described hereinafter. The removal of toner grains of opposite polarity unique to the illustrative embodiment uses the polarity of the toner before removal while the polarity of the toner depends mainly on frictional chargeabililty. It is therefore possible to enhance efficient image transfer and reduce the amount of residual toner by sharply control the distribution of the amounts of frictional charge of toner. Further, it is possible to lower the ratio of the toner grains of opposite polarity to the entire toner grains before removal and therefore to insure stable removal even when the amount of such undesirable toner grains is large.

The toner grains applicable to the illustrative embodiment may be made up of mother grains, which consist of binder resin, a colorant, a charge control agent, organic fine grains and a parting agent and additives coated on the surfaces of the mother grains. To sharply control the charge amount distribution, one or both of the charge control agent and organic fine grains, which have polarity, exist on the surfaces of the mother grains, so that the charge distribution of toner can be made sharp.

Figure 8A:
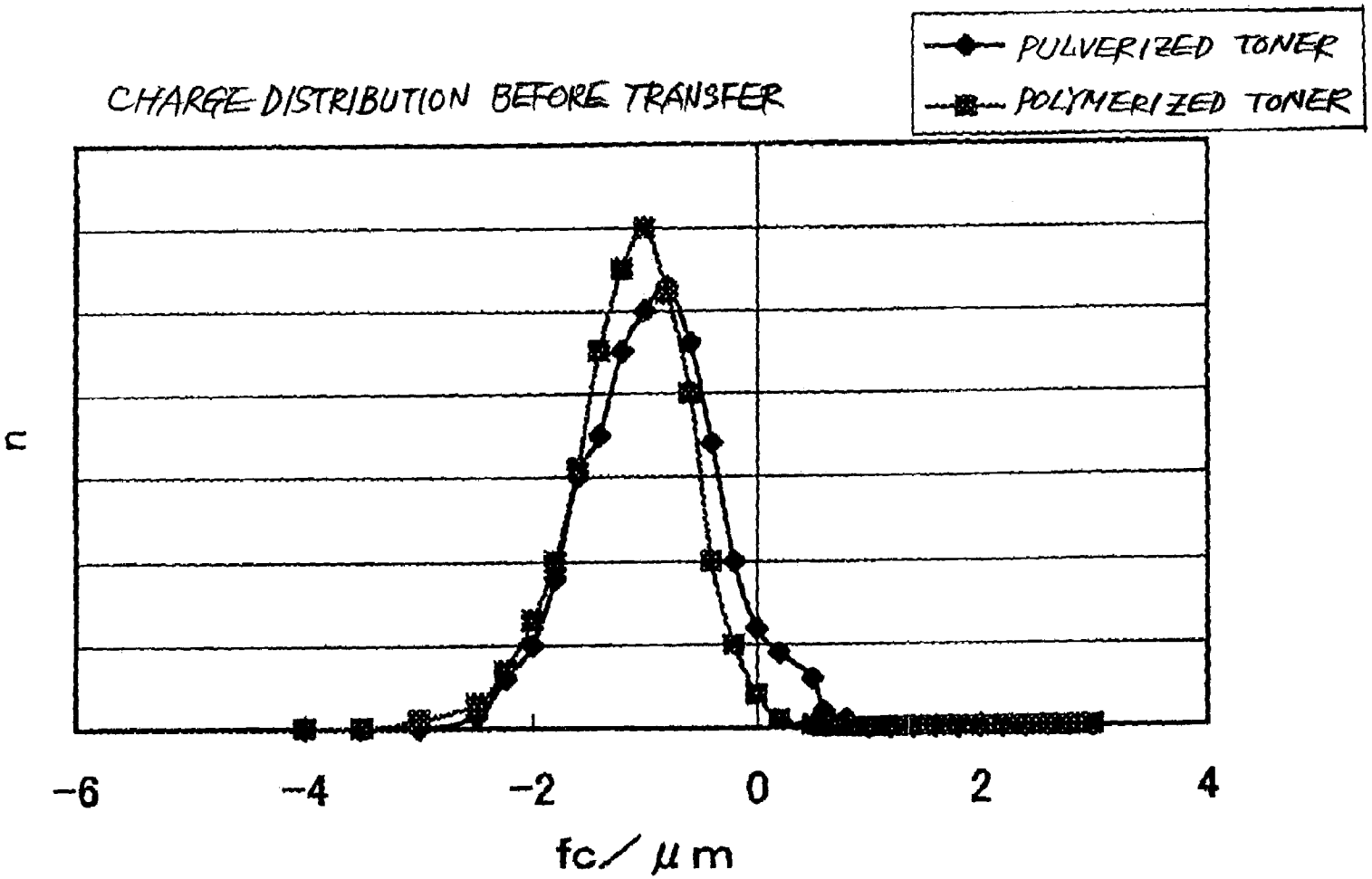
FIGS. 8A and 8B are graphs comparing toner applied to the illustrative embodiment and conventional toner as to a charge distribution.
Figure 8B:
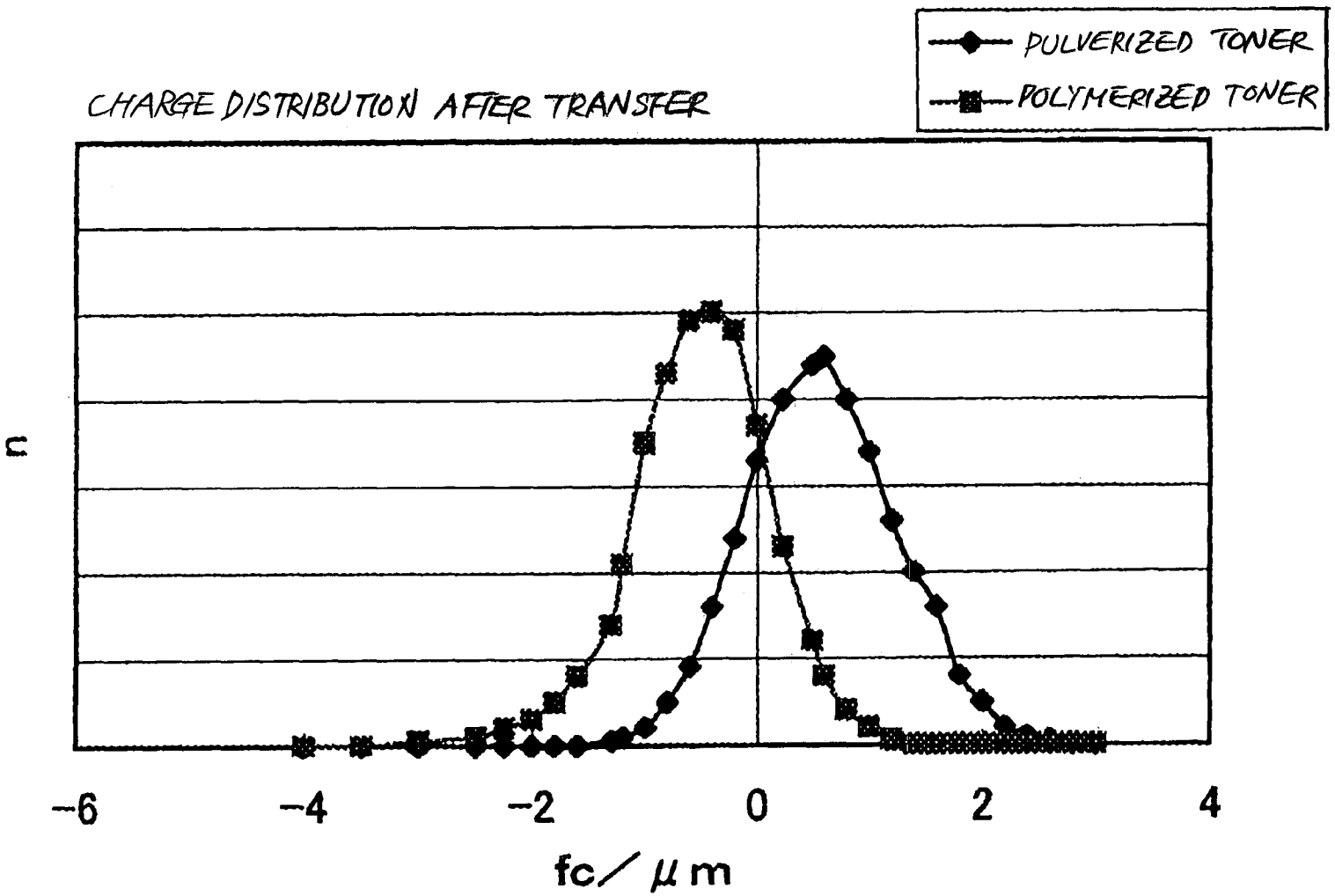

FIGS. 8A and 8B respectively show the variation of charge amount distributions of polymerized toner applied to the illustrative embodiment and conventional pulverized toner determined under the application of a bias for image transfer. FIG. 9 compare the polymerized toner and conventional pulverized toner in terms of specific numerical values derived from experiments.

As FIGS. 8A, 8B and 9 indicate, the polymerized toner applied to the illustrative embodiment is smaller in potential difference between toner grains ascribable to frictional charging than the pulverized toner and therefore makes the charge distribution sharper and chargeability more stable.

As for the charge control agent, the ratio of a weight M present on the surfaces of mother grains to a weight T present over the entire toner grains, i.e., M/T is between 100 and 1,000. This weight ratio M/T is a value measured by an XPS (X-ray Photoelectron Spectrum) method with one of elements up to the fifth period in the long form of the periodic table other than H, C, O and rare-gas elements, the elements up to the fifth period exist in the charge control agent, but do not exist in the other components of the toner.

The binder resin is implemented by polyester having a lower grass transition temperature Tg, providing the toner with high low-temperature fixability. Further, the charge control agent, existing mainly on the surfaces of the toner grains as indicated by the ratio M/T, provides the toner with stable chargeability. The inorganic fine grains, added to the surfaces of the mother grains for enhancing fluidity and promoting charging, are apt to part from the mother grains due to repulsion acting between them and the charge control agent. However, the illustrative embodiment insures cleaning and therefore high image quality if the parting ratio of the inorganic fine grains is between 1.0% and 20.0%.

The volume-mean grain size of the toner should preferably be between 3 μm and 8 μm; the smaller the grain size, the higher the image quality. A volume-mean grain size below 3 μm would make it difficult to form liquid drops while a volume-mean grain size above 8 μm would be inferior to the dry pulverized toner from the cost standpoint, as determined by experiments.

As for the grain size distribution of toner, the ratio of the volume-mean grain size Dv to the number-mean grain size Dn, i.e., Dv/Dn should preferably be 1.25 or below, more preferably between 1.05 and 1.25, from the image quality standpoint. By making the grain size distribution sharp, it is possible to uniform the charge amount distribution for thereby realizing high quality images free from fog. In addition, it is possible to increase the image transfer ratio. A ratio Dv/Dn below 1.05 is difficult to implement for the production reasons.

The polymerized toner grains are close to a true sphere each and have high mean circularity while the pulverized grains have low mean circularity due to random irregularity existing on the surface of the grains. Generally, toner grains with low mean circularity have a broad grain size distribution and are therefore noticeably irregular in the surface area of the individual grain. Such toner grains are therefore noticeably different from each other in the amount of charge deposited by agitation and frictional charging by a doctor when being conveyed in the form of a developer layer. Consequently, the charge distribution of the toner grains in the developer becomes too broad to be evenly subject to the electric field for image transfer on the drum.

By contrast, the polymerized tone grains with high mean circularity all can be controlled in configuration with high accuracy and have therefore a narrow grain size distribution. Consequently, the difference in the amount of frictional charge between the toner grains and therefore the toner charge distribution decreases. This successfully increases the image transfer ratio for thereby reducing the amount of toner grains to be left on the drum after image transfer.

Toner grains desirably charged deposit on the latent image of the drum 1 with priority and consumed thereby. As a result, the ratio of toner grains not desirably charged to the entire toner grains in the developing device 5 increases. Therefore, in the case of the pulverized toner grains or similar toner grains having low mean circularity and therefore a broad charge distribution, toner grains undesirably charged are left in the developing device 5 in a large amount due to repeated use. Such toner grains fail to accurately deposit on the latent image of the drum 1 although they are subject to the electric field in the developing zone. Therefore, when the mean circularity is low, background contamination, irregularity in dots and other defects occur due to repeated use, lowering image quality.

Furthermore, the low mean circularity translates into an increase in area over which the toner grains contact the carrier grains, thereby easily causing toner spent to occur. Toner spent, which refers to the filming of toner grains on carrier grains, grows worse with the elapse of time. Toner spent obstructs the frictional charging of fresh toner grains replenished to the developing device 5 and is also considered to degrade image quality.

By contrast, the toner grains with high mean circularity and therefore narrow charge distribution applied to the illustrative embodiment contain a far smaller amount of toner grains of undesirable charge than the toner grains with low mean circularity. Such toner grains therefore cause a minimum of background contamination, irregularity in dots and other defects despite a long time of use. Further, the high mean circularity reduces the area over which the toner grains contact carrier grains for thereby preventing toner spend from easily occurring, so that high image quality is insured over a long period of time.

The adequate value of mean circularity was determined by the following experiments. A developing device storing a developer was idled to determine a period of time in which toner spent was observed. FIG. 10 lists the results of experiments. When the mean circularity was 0.93 or above, toner spent was not observed at all even in 4,200 minutes corresponding to a period of time necessary for outputting 150,000 prints, which is generally used as a reference number of prints for estimation. The illustrative embodiment therefore uses toner grains having mean circularity of 0.93or above.

The mean circularity was determined by the following procedure using a flow type grain image analyzer FPIA-2100 (trade name) available from SYSMEX CORPORATION. First, a 1% NaCl aqueous solution is prepared by using primary sodium chloride. The NaCl aqueous solution is then passed through a 0.45 filter in order to produce 40 ml to 100 ml of liquid. Subsequently, 0.1 ml to 5 ml of surfactant, preferably alkylbenzene solfonate, is added to the above liquid, and then 1 mg to 10 mg of sample is added. The resulting mixture is dispersed for 1 minute in an ultrasonic dispersing device to thereby regulate the grain density to 5,000 grains/μl to 15,000 grains/μl. The liquid thus dispersed is picked up by a CCD (Charge Coupled Device) camera. Thereafter, the circumferential length of a circle identical in area with the area of the bidimensional projection image of the toner grain is divided by the circumferential length of the projection image of the toner grain, thereby producing circularity of the individual toner grain. Considering the accuracy of the CCDs or pixels, it was determined that a toner grain was acceptable if the diameter of the circle identical in area with the bidimensional projection image of the toner grain was 0.6 μm or above. Finally, the circularities of the acceptable toner grains are added and then divided by the number of toner grains to thereby produce mean circularity.

The toner applicable to the illustrative embodiment may be produced by suspension polymerization that mixes a monomer, a starter, a colorant and so forth and then polymerizes, washes, dries and then executes postprocessing with the mixture. Suspension polymerization may be replaced with emulsion polymerization, bulk polymerization or solution polymerization, if desired.

The circularity should preferably be between 100 and 180 in terms of shape coefficient SF-1 and between 100 and 190 in terms of shape coefficient SF-2.

FIGS. 11A and 11B each show a specific configuration of a toner grain for describing the shape coefficients SF-1 and SF-2. The shape coefficient SF-1, representative of the degree of circularity of a toner grain, is produced by dividing the square of the maximum length MXLNG of a shape produced by projecting a toner grain in a bidimensional plane by the area AREA of the shape and then multiplying the resulting quotient by 100π/4, i.e.:

$$SF\text{-}1=\{(\mathrm{MXLNG})^2/\mathrm{AREA}\}\times(100\pi/4) \qquad \text{Eq. (1)}$$

The toner shape is truly spherical when SF-1 is 100 or becomes more amorphous with an increase in SF-1.

The shape coefficient SF-2, representative of the ratio of irregularity of the toner shape, is produced by dividing the square of the circumferential length PERI of a shaped produced by projecting a toner grain in a bidimensional plane by the area AREA of the shape and then multiplying the resulting quotient by 100π/4, i.e.:

$$SF\text{-}2=\{(\mathrm{PERI})^2\}/\mathrm{AREA}\}\times(100\pi/4) \qquad \text{Eq. (2)}$$

The irregularity on the surface of the toner grain is zero when SF-2 is 100 or becomes more noticeable with an increase in SF-2.

To measure the shape coefficients SF-1 and SF-2, a toner grain was picked up by a scanning electron microscope S-800 (trade name) available from Hitachi, Ltd. and then input to an image analyzer LUSEX3 (trade name) available from NIREKO CO., LTD.

The shape coefficients SF-1 and SF-2 both should preferably be 100 or above. When SF-1 and SF-2 increase, the toner grains are scattered on an image to thereby lower image quality. Therefore, SF-1 and SF-2 should preferably do not exceed 180 and 190, respectively.

Each toner grain should preferably be harder on the surface than in the side. The hardness of the entire toner grain can be determined by analyzing the components of the toner grain. Urea-bond polyester resin is harder when containing more nitrogen (N) atoms. This can be confirmed by measuring the composition distribution with the XPS method.

By hardening the surface of each toner grain, it is possible to obviate blocking even after a long time of use and to enhance fluidity of the toner grain for thereby promoting agitation and mixture. Further, the hard surface prevents the additives, coating the surface, from being buried in the surface, so that the fluidity and chargeability of the toner are maintained constant. Moreover, the low hardness of the inside of the toner grain allows the surface to be easily broken and deformed by heat and pressure in the event of fixation, so that the inside of the toner grain, containing the parting agent, can be exposed for enhancing fixability.

Specific components of the toner and methods of producing the same will be described hereinafter.

(Colorant)

Any one of conventional dyes and pigments may be used for the colorant. The dyes and pigments include carbon black, Nigrosine dye, iron black, Naphthol Yellow S, Hansa Yellow (10G, 5G, G), Cadmium Yellow, yellow iron oxide, ocher, Chrome Yellow, TitaniumYellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL, isoindolinone yellow, red oxide, minium, red lead, Cadmium Red, Cadmium Mercury Red, Antimony Red, Parmanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosine Lake, Rhodamine Lake B, Rhodamine Lake Y, Alizarin Lake, Thioindigo Red B, ThioindigoMaroon, Oil Red, Quinacridone Red, Pyrazolone Red, polyazo red, Chrome Vermilion, Benzidine Orange, Perinon Orange, Oil Orange, cobalt blue, cerulean blue, alkali blue lake, Peacock Blue lake, Victoria Blue lake, non-metallic Phthalocyanine Blue, Phthalocyanine Blue, Fast Skyblue, Indanthrene Blue (RS, BC), indigo, Ultramarine Blue, Berlin Blue, Anthraquinone Blue, Fast Violet B, Methyl Violet Lake, cobalt violet, manganese violet, dioxane violet, Anthraquinone Violet, Chrome Green, Zink Green, chrome oxide, pyridian, Emerald Green, Pigment Green B, Naphthol Green B, Green Gold, Acid Green Lake, Malachite Green Lake, Phthalocyanine Green, Anthraquinone Green, titanium oxide, zinc white, lithopone, and the mixtures thereof. The content of the colorant is usually 1 wt. % to 15 wt. %, preferably 3 wt % 10 wt. %, of the entire toner.

The colorant may be used as a master batch combined with a resin. Binder resin used for manufacturing the master batch or kneaded with the master batch may be any one of styrene polymer and polymer of substituents thereof, e.g., polystyrene, poly-p-chlorostyrene, and polyvinyltoluene, or copolymers of these with vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, modified rosin, terpene resin, aliphatic or alicyclic hydrocarbon resin, aromatic petroleum resin, chlorinated paraffin, and paraffin wax. Such binder resins may be used either singly or in combination.

(Polyester)

Polyester is produced by the condensation polymerization reaction of a polyhydric alcohol compound with a polyhydric carboxylic acid compound. As for the polyhydric alcohol compound (PO), use may be made of dihydric alcohol (DIO) or polyhydric alcohol (TO) higher than trihydric alcohol, preferably only DIO or a mixture of DIO with a small amount of ITO. As for dihydric alcohol (DIO), there may be used any one of alkylene glycol (ethylene glycol, 1,2-propylene glycol, 1,3-propylene glycol, 1,4-butanediol, 1,6-hexanediol, etc.); alkylene ether glycol (diethylene glycol, triethylene glycol, dipropylene glycol, polyethylene glycol, polypropylene glycol, polytetramethylene ether glycol, etc.); alicyclic diol (1,4-cyclohexane dimethanol, hydrogenated bisphenol A, etc.); bisphenols (bisphenol A, bisphenol F, bisphenol S, etc.); the above alicyclic diol added with alkylene oxide (ethylene oxide, propylene oxide, butylenes oxide, etc.); the above bisphenols added with alkylene oxide (ethylene oxide, propylene oxide, butylenes oxide, etc.). Among them, 2-12C alkylene glycol and bisphenols added with alkylene oxide are preferable, particularly bisphenols added with alkylene oxide, and this bisphenol jointly used with 2-12C alkylene glycol are preferable. As the polyhydric alcohol (TO) higher than trihydric alcohol, polyhydric aliphatic alcohol of tri-octa hydric or higher (glycerol, trimethylol ethane, trimethylol propane, penta erythritol, sorbitol, etc.); trihydric or higher phenols (trisphenol PA, phenol novolak, cresol novolak, etc.); and the above trihydric or higher polyphenols added with alkylene oxide.

Dihydric carboxylic acid (DIC) and trihydric or higher polyhydric carboxylic acid (TC) may be used as polyhydric carboxylic acid (PC); only DIC or a mixture of DIC with a small amount of TC is preferable. As for the dihydric carboxylic acid (DIC), any one of alkylene dicarboxylic acid (succinic acid, adipic acid, sebacic acid, etc.); alkenylendicarboxylic acid (maleic acid, fumaric acid, etc.); aromatic dicarboxylic acid (phthalic acid, isophthalic acid, terephthalic acid, naphthalenedicarboxylic acid, etc.) may be used. Among them, 4-20C alkenylenedicarboxylic acid and 8-20C aromatic dicarboxylic acid are preferable. As for the trihydric or higher polyhydric carboxylic acid (TC), 9-20C aromatic polyhydric carboxylic acid (trimellitic acid, pyromellitic acid, etc.) may be used. Polyhydric carboxylic acid (PC) may be reacted with polyhydric alcohol (PO) using anhydride of the above substances or lower alkylester (methyl ester, ethyl ester, isopropyl ester, etc.). The ratio of polyhydric alcohol (PO) to polyhydric carboxylic acid (PC) is usually 2/1 to 1/1, preferably 1.5/1 to 1/1, more preferably 1.3/1 to 1.02/1, in terms of an equivalent ratio of a hydroxyl group [OH]/and a carboxylic group [COOH].

In the condensation polymerization reaction of polyhydric alcohol (PO) with polyhydric carboxylic acid (PC), PO and PC are heated to 150° C. to 280° C. in the presence of the known esterification catalyst, e.g., tetrabutoxy titanate or dibutyltineoxide. The resulting water is distilled off with pressure being lowered, if necessary, to obtain polyester containing a hydroxyl group. The hydroxyl value of polyester is preferably 5 or above while the acid value of polyester is usually between 1 and 30, preferably between 5 and 20. By imparting the acid value, polyester is easily negatively charged to improve the affinity of the toner with recording paper in fixing on a sheet. However, an acid value above 30 has adverse influence on stable charging, particularly on the environmental variation.

A weight-mean molecular weight is between 10,000 and 400,000, preferably, 20,000 and 200,000. A weight-mean molecular weight below 10,000 lowers offset resistance while a weight-mean molecular weight above 400,000 deteriorates low temperature fixability.

Polyester preferably contains urea-modified polyester in addition to the above unmodified polyester produced by the condensation polymerization reaction. Urea-modified polyester is produced by reacting the carboxylic group or hydroxyl group at the terminal of polyester obtained by the above condensation polymerization reaction with a polyvalent isocyanate compound (PIC) to obtain polyester prepolymer (A) having an isocyanate group, and reacting it with amines to crosslink and/or extend the molecular chain.

As for the polyvalent isocyanate compound (PIC), us may be made of any one of aliphatic polyvalent isocyanate (tetra methylenediisocyanate, hexamethylenediisocyanate, 2,6-diisocyanate methyl caproate, etc.); alicyclic polyisocyanate (isophoronediisocyanate, cyclohexylmethane diisocyanate, etc.); aromatic diisocyanate (tolylenediisocyanate, diphenylmethene diisocyanate, etc.); aroma-aliphatic diisocyanate (α,α,α',α'-tetramethylxylene diisocynate, etc.); isocaynates; the above isocyanats blocked with phenol derivatives, oxime, caprolactam, etc.; and a combination of two or more of them.

The ratio of the polyvalent isocyanate compound (PIC) is usually 5/1 to 1/1, preferably 4/1 to 1.2/1 or more preferably 2.5/1 to 1.5/1, in terms of the equivalent ratio of an isocyanate group [NCO]/a hydroxyl group [OH] of polyester having the isocyanate group and the hydroxyl group. A ratio [NCO]/OH higher than 5 would deteriorate low-temperature fixability. As for a molar ratio of NCO below than 1, if the urea-modified polyester is used, then the urea content in the ester is low, lowering the hot offset resistance.

The content of the constitution component of the polyvalent isocyanate compound (PIC) in polyester prepolymer (A) having the isocyanate group is usually 0.5 wt. % to 40 wt. %, preferably 1 wt. % to 30 wt. % or more preferably 2 wt. % to 20 wt. %. A content below 0.5 wt. % deteriorates the hot offset resistance and causes disadvantageous compatibility of the heat resisting preservation property with the low temperature fixing property. A content higher than 40 wt. % deteriorates the low temperature fixability.

The number of isocyanate groups contained per molecule of polyester prepolymer (A) having the isocyanate group is usually more than one, preferably 1.5 to 3 in average or more preferably 1.8 to 2.5 in average. If the number of isocyanate groups is less than one per molecule, then the molecular weight of urea-modified polyester is low, deteriorating the hot offset resistance.

As for amines (B), reacting with polyester prepolymer (A), there may be used any one of a divalent amine compound (B1), a polyvalent amine compound (B2) of trivalent or higher, amino alcohol (B3), aminomercaptan (B4), amino acid (B5), and a substance (6) with amino groups of B1-B5 blocked.

As for the divalent amine compound (B1), there may be used any one of aromatic diamine (phenylenediamine, diethyltoluenediamine, 4,4'-diamino diphenyl methane, etc.); alicyclic diamine (4,4'-diamino-3,3'-dimethyl dicyclohexylmethane, diamine cyclohexane, isophorone diamine, etc.); and aliphatic diamine (ethylene diamine, tetramethylene diamine, hexamethylene diamine, etc.) are listed. As for polyvalent amine compounds (B2) of trivalent or higher, there may be used any one of diethylene triamine, triethylene tetramine, and so forth. As for amino alcohol (B3), ethanolamine, hydroxyethyl aniline or the like may be used. As for aminomercaptan (B4), use may be made of aminoethyl mercaptan, amino propylmercaptan or the like. As for amino acid (B5), use may be made of amino propionic acid, aminocaproic acid or the like. As the for substances (B6) consisting of B1-B5 with their amino groups blocked, use may be made of any one of a ketimine compound obtained from the above amines B1-B5 and ketones (acetone, methyl ethyl ketone, methyl isobutyl ketone, etc.), an oxazolidine compound, and so forth. Among them, preferable amines (B) are B1 and a mixture of B1 and a small amount of B2.

The ratio of amines (B) is usually 1/2 to 2/1, preferably 1.5/1 to 1/1.5 or more preferably 1.2/1 to 1/1.2, in terms of the equivalent ratio of [NCO]/[NHx] of the isocyanate group [NCO] in polyester prepolymer (A) having the isocyanate group and the amino group [NHx] in amines (B). A ratio NCO/NHX above 2 or below 1/2 lowers the molecular weight of urea-modified polyester, deteriorating the hot offset resistant property.

A urethane bond, as well as a urea bond, may be contained in urea-modified polyester. A molar ratio of the urea bond content to the urethane bond content is usually 100/0 to 10/90, preferably 80/20 to 20/80 or more preferably 60/40 to 30/70. A molar ratio of the urea bond below 10% deteriorates the hot offset resistance.

Urea modified polyester is produced by, e.g., the one-shot method. Polyester having the hydroxyl group is produced by reacting polyhydric alcohol (PO) with polyhydric carboxylic acid (PC), in the presence of a known esterification catalyst, e.g., tetrabutoxy titanate, dibutyltineoxide or the like, heating to 150° C. to 280° C. with pressure being reduced, if necessary, and distilling off the resulting water. Then, by reacting polyvalent isocyanate (PIC) with polyester obtained at 40-140° C., polyester prepolymer (A) having the isocyanate group is obtained The prepolymer (A) is reacted with amines (B) at 0° C. to 140° C. to obtain urea-modified polyester At the time of reacting (PIC) and reacting (A) with (B), a solvent may be used, if necessary. The solvent may be selected from any one of a group of solvents inactive to isocyanate (PIC), e.g., an aromatic solvent (toluene, xylene, etc.); ketones (acetone, methyl ethyl ketone, methyl isobutyl ketone, etc.); esters (ethyl acetate, etc.); amides (dimethyl formamide, dimethyl acetatamide, etc.); and ethers (tetrahydrofuran, etc.).

If necessary, a reaction terminator may be used for the cross-linking reaction and/or extension reaction of polyester prepolymer (A) with amines (B), to control the molecular weight of obtained urea-modified polyester. The reaction terminating agents include monoamine (diethylamine, dibutylamine, butylamine, lauryl amine, etc.), and blocked substances thereof (a ketimine compound).

The weight-mean molecular weight of urea-modified polyester is usually 10,000 or above, preferably 20,000 to 10,000,000 or more preferably 30,000 to 1,000,000. A molecular weight of less than 10,000 deteriorates the hot offset resisting property. The number-mean molecular weight of urea-modified polyester or the like is not limited when the above unmodified polyester is used, but the number-mean molecular weight that allows the above weight-mean molecular weight to be attained is acceptable. In the case where urea-modified polyester is used in a single form, its number-mean molecular weight is 2,000 to 15,000, preferably 2,000 to 10,000 or more preferably 2,000 to 8,000. A molecular weight higher than 20,000 deteriorates the low temperature fixability and luster when urea-modified polyester is used in a full-color image forming apparatus.

By using unmodified polyester and urea-modified polyester in combination, it is possible to improve low-temperature fixability and, when a full-color apparatus is used, luster. In this sense, the above combination is more preferable than only urea-modified polyester. It is to be noted that unmodified polyester may contain polyester modified by a chemical bond other than the urea bond.

Unmodified polyester and urea-modified polyester should desirably be at least partly in a compatible state from the low temperature fixability and hot offset resistance standpoint. Therefore, unmodified polyester and urea-modified polyester should preferably have a similar composition. The weight ratio of unmodified polyester to urea-modified polyester is usually 20/80 to 95/5, preferably 70/30 to 95/5 or more preferably 75/25 to 95/5 or even more preferably 80/20 to 93/7. A weight ratio of urea-modified polyester below 5% deteriorates the hot offset and causes disadvantageous compatibility of the heat resisting preserving property and low temperature fixability.

The glass transition temperature Tg of the binder resin containing unmodified polyester and urea-modified polyester is usually 45° C. to 65° C., preferably 45° C. to 60° C.

Glass transition temperature below 45° C. deteriorates the heat resisting property of the toner while a temperature higher than 65° C. makes the low temperature fixing property short. Because urea-modified polyester is apt to exist on the surfaces of the mother grains, it exhibits a more desirable heat resisting preserving property than the conventional polyester-based toner grains even if glass transition temperature is low.

(Charge Control Agent)

As for the charge control agent, which is contained in color toner in the illustrative embodiment, use may be made of any one of conventional colorless or monochrome agents that do not bring about color tone defects. For example, as for a positive charge type of agent, any one of a quaternary ammonium chloride compound may be used while as for a negative charge type of agent, there may be used any conventional material, e.g., a metallic complex or metallic salt of chromium, zinc, aluminum, etc. of salicylic acid or alkylsalicylic acid, a metallic complex or metallic salt of benzilic acid, an amide compound, a phenol compound and a naphthol compound may be used either singly or in combination. Particularly, at least one of the metallic complex or metallic salt of salicylic acid, an organic boron compound, an oxynaphthoic acid-based metallic complex or metallic salt and a fluorine-containing ammonium chloride compound is preferable. More specifically, a salicylic acid-based metallic complex E-84 (trade name) available from Orient Chemical Industries Co. Ltd., LR-147, a boron complex LR-147 (trade name) available from Japan Carlit Co. Ltd. or an oxynaphthoic acid-based metallic complex E-82 (trade name) also available from Orient Chemical Industries Co. Ltd. may be used.

The amount of the charge control agent to be used is determined by the type of the binder resin, whether or not an additive is used or the toner producing method including the dispersion method and not unconditionally limited. However, charge control agent should preferably by used by 0.1 pts.wt to 10 pts.wt., preferably 0.2 pts.wt to 5 pts.wt., to 100 pts.wt. of the binder resin. An amount above 10 pts.wt. makes the charge ability of toner excessive and therefore reduces the effect of the main charge control agent while increasing electrostatic attraction with the developing roller. As a result, the fluidity of the developer and image density are lowered.

(Organic Fine Grains)

Organic fine grains are added to stabilize the toner mother grains formed in an aqueous medium. In particular, at least one of vinyl resin, polyurethane resin, epoxy resin, silicone resin, polyester resin and fluororesin is preferably used. More specifically, the organic fine grains may be 1 μm and 3 μm methyl polymethacrylate, 0.5 μm and 2 μm polystyrene, 1 μm poly(styrene-acrylonitrile); PB-200H (trade name) available from Kao Co. Ltd., SGP (trade) available from Soken Co. Ltd., Technopolymer SB (trade name) available from Sekisui Chemical Co. Ltd., SGP-3G (trade name) available from Soken Co. Ltd., Micropearl (trande name) available from Sekisui Fine Chemical Co. Ltd.) are examples available on the market.

(Parting Agent)

The above toner should preferably contain a parting agent, e.g., wax having a melting point as low as 50° C. to 120° C. that acts more effectively between the heat roller and the toner than in the dispersion with the binder resin and thereby copes with high-temperature offset without resorting to oil or similar parting agent otherwise coated on the heat roller. The wax may be selected from any one of a group of vegetable waxes including carnauba wax, cotton wax, Japan wax, rice wax a group of animal waxes including beeswax and lanolin; a group of mineral waxes including ozokerite and selsyn; and a group of petroleum waxes including paraffin, microcrystalline, and petrolatum. Besides, use may be made of synthetic hydrocarbon waxes including Fischer-Tropsch wax, polyethylene wax, and synthetic waxes including ester, ketone and ether. Further, fatty amides including 12-hydroxyl stearic acid amide, stearic acid amide, phthalic anhydride imide, and chlorinated hydrocarbon, and crystalline polymers having long alkyl groups in side chains, including homopolymer of polyacrylate of poly-n-stearyl methacrylate and poly-n-lauryl methacrylate which are crystalline high polymer resins of low molecular weight or copolymers including a copolymer of n-stearyl acrylate with ethylmethacrylate) may also be used.

The charge control agent and parting agent may be kneaded together with the master batch and binder resin or may, of course, be added when it is dissolved or dispersed in an organic solved.

(External Additive)

Inorganic fine grains should preferably be used for further promoting the fluidity, developing ability and charging ability of the toner grains. The primary grain size of the inorganic fine grains should preferably be $5\times10^{-3}$ to 2 μm, particularly $5\times10^{-3}$ μm to 0.5 μm. A specific area measured by a BET method should preferably be 20 $m^2/g$ to 500 $m^2/g$. The ratio of the inorganic grains to the entire toner grains should preferably be 0.01 wt. % to 5 wt. %, more preferably 0.01 wt. % to 2.0 wt. %. A ratio below 0.01 wt. % brings about insufficient fluidity while a ratio above 5 wt. % brings about easy separation of the external additive from the toner grains.

Specific examples of the inorganic fine grains are silica, alumina, titanium oxide, barium titanate, magnesiumtitanate, calciumtiatanate, strontiumtitanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination. Particularly, when such two kinds of fine grains, having a mean grain size of 5×10-2 μm or below, are mixed together, there can be noticeably improved an electrostatic force and van del Waals force with the toner. Therefore, despite agitation effected in the developing device for implementing the desired charge level, the fluidity imparting agent does not part from the toner grains and insures desirable image quality free from spots or similar image defects. In addition, there can be reduced the amount of residual toner.

Titanium oxide fine grains are desirable in environmental stability and image density stability, but tend to lower in charge start characteristics. Therefore, if the amount of titanium oxide fine particles is larger than the amount of silica fine grains, then the influence of the above side effect is considered to increase. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operation.

A method of producing the toner, which is preferable, but not limitative, will be described hereinafter.

1) First, a colorant, unmodified polyester, polyester prepolymer having isocyanate groups and a parting agent are dispersed into an organic solvent to prepare a toner material liquid. The organic solvent should preferably be volatile and have a boiling point of 100° C. or below because such a solvent is easy to remove after the formation of the toner mother grains. More specifically, use may be made of one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent, e.g., toluene or xylene or a hydrocarbon halide, e.g., methylene chloride, 1,2-dichloroethane, chloroform or carbon tetrachloride is desirable. The amount of the organic solvent to be used should preferably 0 pts.wt. to 300 pts.wt., more preferably 0 pts.wt. to 100 pts.wt. or even more preferably 25 pts.wt. to 70 pts.wt., for 100 pts.wt. of polyester prepolymer.

2) The toner material liquid is emulsified in an aqueous medium in the presence of a surfactant and organic fine grains. The aqueous medium may be only water or water containing an organic solvent, e.g., alcohol (methanol, isopropyl alcohol, ethylene glycol, etc.), dimethylformamide, tetrahydrofuran, cellusolves (methyl cellusolve, etc.) or lower ketones (acetone, methyl ethyl ketone, etc.).

The amount of the aqueous medium for 100 pts.wt. of the toner material liquid is usually 50 pts.wt. to 2,000 pts.wt., preferably 100 pts.wt. to 1,000 pts.wt. An amount below 50 pts.wt. makes the dispersion state of the toner material liquid insufficient and thereby prevents the toner grains of the preselected grain size from being obtained. An amount above 2,000 pts.wt. is not desirable from the cost standpoint.

An adequate amount of dispersant, e.g., a surfactant or organic fine grains is added to promote the dispersion in the aqueous medium. The surfactant may be any one of an anionic surfactant, e.g., alkyl benzene sulfonate, α-olefin sulfonate, or ester phosphate; a cationic surfactant, e.g., an amine salt type like alkylamine salt, aminoalcohol fatty acid derivatives, polyamine fatty acid derivatives, imidazolin, and a quarternary ammonium salt type like alkyltrimethyl ammonium salt, dialkyldimethyl ammonium salt, alkyldimethylbenzil ammonium salt, pyridinium salt, alkyl isoquinolinium salt or benzetonium chloride; a non-ionic surfactant, e.g., an fatty acid amide derivative or a polyhydric alcohol derivative; or an amphoteric surfactant, e.g., alanin, dodecyldi(aminoethyl) glycine, di(octylaminoethyl) glycine or N-alkyl-N,N-dimethylammonium betaine.

A surfactant having a fluoroalkyl group improves the effect of the dispersant when added in an extremely small amount. Preferable anionic surfactants having fluoroalkyl groups include 2-10C fluoroalkylcarboxylic acid and its metallic salts, disodium perfluorooctane sulfonyl glutamate, sodium 3-[ω-(6-11C) fluoroalkyl oxy]-1-(3-4C)alkyl sulfonate, sodium 3-[ω-(6-8C) fluoroalkanoyl-N-ethylamino]-1-propanesulfonate, 11-20C fluoroalkyl carboxylic acid and its metallic salts, 7-13C perfluoroalkyl carboxylic acid and its metallic salts, 4-12 C perfluoroalkyl sulfonic acid and its metallic salts, perfluorooctane sulfonic acid diethanolamide, N-propyl-N-(2-hydroxyethyl) perfluorooctane sulfonamide, 6-1° C. perfluoro alkyl sulfonamide propyl trimethyl ammonium salt, 6-10C perfluoroalkyl-N-ethylsulfonyl glycine salt and 6-16C mono-perfluoro alkyl ethyl phosphate. For the anionic surfactants, the following products are available on the market, i.e., Surfron S-111, S-112 and S-113 (trade names) available from Asahi Glass Co. Ltd., Fluorad FC-93, FC-95, FC-98 and FC-129 (trande namers) available from Sumitomo 3M Co. Ltd., Unidyne DS-101, DS-102 (trade names) available from Daikin Industries Co. Ltd., Megafack F-110, F-120, F-113, F-191, F-812 and F-833 (trade names) also available from Dainippon Ink Co. Ltd., Ektop EF-102, 103, 104, 105, 112, 123A, 123B, 306A, 501, 201 and 204 (trade names) available from Tokem Products Co. Ltd., Phthargent F-100 and F-150 (trade names) available from Neos Co. Ltd.), and so forth.

For the cationic surfactants, there may be used any one of aliphatic primary, secondary or tertiary amic acid having fluoroalkyl groups; an aliphatic quaternary ammonium salt, e.g., 6-10C perfluoroalkyl sulfonamide propyltrimethyl ammonium salt or benzalkonium salt; benzetonium chloride, pyridinium salt or imidazolinium salt; or Surfron S-121 (trade name) available from Asahi Glass Co. Ltd., Fluorad FC-135 (trade name) available from Sumitomo 3M Co. Ltd., Unidyne DS-202 (trade name) available from Daikin Industries Co. Ltd., Megafack F-150 or F-824 (trade name) available from Dainippon Ink Co. Ltd., Ektop EF-132 (trade name) available from Tokem Products Co. Ltd., and Phthargent F-300 (trade name) available from Neos Co. Ltd.

An inorganic compound dispersant, e.g., tricalcium phosphate, calcium carbonate, titanium oxide, colloidal silica or hydroxyl apatite may also be used.

Further, dispersant droplets may be stabilized by high polymer-based protective colloid as a dispersant usable together with organic fine grains or inorganic compound dispersant. The protective colloid may be any one of acids, e.g., acrylic acid, methacrylic acid, α-cyanoacrylic acid, α-cyanomethacrylic acid, itaconic acid, crotonic acid, fumaric acid, maleic acid and maleic anhydride; (meth) acrylic monomers having a hydroxyl group, e.g., acrylic acid-β-hydroxyethyl, methacrylic acid-β-hydroxyethyl, acrylic acid-β-hydroxypropyl, methacrylic acid-β-hydroxypropyl, acrylic acid-y-hydroxypropyl, methacrylic acid-y-hydroxypropyl, acrylic acid-3-chloro-2-hydroxypropyl, methacrylic acid-3-chloro-2-hydroxypropyl, diethyleneglycol monoacrylic ester, diethyleneglycol monomethacrylic ester, glycerol monoacrylic ester, glycerol monomethacrylic ester, N-methylolacrylamide and N-methylolmethacrylamide; vinyl alcohols or ethers with vinyl alcohol, e.g., vinyl methyl ether, vinyl ethyl ether and vinyl propyl ether; esters of vinyl alcohol with a compound having a carboxylic group, e.g., vinyl acetate, vinyl propionate and vinyl butyrate; acrylamide, methacrylamide, diacetone acrylamide and methyol compounds thereof; acid chlorides, e.g., chloride acrylate and chloride methacrylate; nitrogen-containing compounds, e.g., vinyl pyridine, vinyl pyrrolidone, vinyl imidazole and ethyleneimine; and homopolymers or copolymers of heterocyclic compounds thereof; polyoxyethylenic substances, e.g., polyoxyethylene, polyoxyl propylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester and polyoxyethylene nonylphenyl ester; and celluloses, e.g., methylcellulose, hydroxylethylcellulose and hydroxylpropyl cellulose.

The dispersion method may be implemented by any one of conventional dispersion facilities, e.g., a low speed shearing type, high speed shearing type, friction type, high pressure jet type and ultrasonic type. Among them, the high speed shearing type is preferable for implementing the dispersed grains with a grain size of 2 μm to 20 μm. The number of rotation of the high speed shearing type disperser is not limited, but is usually 1,000 rpm (revolutions per minute) to 30,000 rpm, preferably 5,000 rpm to 20,000 rpm. While the dispersion time is not limited, it is usually 0.1 minute to 5 minutes for the batch system. A dispersion temperature is usually 0° C. to 150° C., preferably 40° C. to 98° C. in a pressurized condition.

3) At the same time as the production of the emulsion, amines (B) are added to the emulsion in order to cause the emulsion to react with the polyester prepolymer (A) having isocyanate groups. The reaction causes the crosslinking and/or extension of the molecular chains to occur. The reaction time is selected in accordance with the reactivity of the isocyanate group structure of the polyester prepolymer (A) with amines (B) and is usually 10 minutes to 40 hours, preferably 2 hours to 24 hours. A reaction temperature is usually 0° C. to 150° C., preferably 40° C. to 98° C. At this instant, use may be made of any conventional catalyst, e.g., dibutyltinelaulate or dioctyltinelaulate, if necessary.

4) After the above reaction, the organic solvent is removed from the emulsified dispersed matter (reaction product), washed and then dried to obtain the toner mother grains. To remove the inorganic solvent, the entire system is gradually heated in a laminar-flow agitating state, strongly agitated in a preselected temperature range, and then subjected to solvent removal, so that fusiform toner mother grains are produced. Alternatively, when the dispersion stabilizer is implemented by, e.g., calcium phosphate, soluble in acid or alkali, calcium phosphate is removed from the toner mother grains by dissolving calcium phosphate by hydrochloric acid or similar acid and washing with water. Further, use may be made of decomposition using an enzyme.

5) The charge control agent is placed into the above toner mother grains, and then the inorganic fine grains are externally added to obtain the toner. The placing of the charge control agent and external addition of the inorganic fine grains may be performed by any conventional method using, e.g., a mixer.

By the above procedure, it is possible to achieve toner grains small in size and having a sharp grain size distribution. Further, by strongly agitating the grains in the organic solvent removing process, it is possible to control the spherical shape.

As stated above, even when the illustrative embodiment is implemented as a cleaningless image forming apparatus, it is possible to effectively remove toner grains of opposite polarity and therefore obviate the variation of charge start voltage ascribable to the above toner grains. This not only obviates a decrease in image density, background contamination and irregularity in image density, but also reduces the size and cost of the apparatus. Further, by using toner free from scattering and insuring a high image transfer ratio, it is possible to enhance image quality.

Second Embodiment

A second embodiment of the present invention, directed mainly toward the second object stated earlier, will be described hereinafter. Because most part of the description made with reference to FIGS. 1 through 5, which show the first embodiment, directly apply to the second embodiment, the following description will concentrate only on differences between the first and second embodiments.

Generally, a change in temperature or humidity causes the surface potential of the drum 1 uniformly charged by the charging device 3 to vary. Also, the amount of charge deposited on the toner by agitation in the developing device 5 varies, so that the amount of toner to deposit on the latent image of the drum 1 varies. The variation of the drum surface potential and that of the amount of toner to deposit on the latent image directly effect image quality. For example, when humidity is high, the amount of charge of toner decreases and causes the amount of toner to deposit on the latent image to increase, aggravating contamination ascribable to toner and thereby lowering image quality.

It has been customary to cope with the degradation of image quality ascribable to temperature or humidity with, e.g., bias control means that varies the charge bias, development bias or similar bias in accordance with temperature and humidity. The bias control means, however, must deal with different portions susceptible to the variation of temperature and that of humidity one by one and therefore needs a sophisticated configuration. Moreover, it is extremely difficult for the bias control means to fully cope with the variation of temperature and that of humidity.

In light of the above, in the illustrative embodiment, the process cartridge 30 is provided with a substantially hermetic or air-tight configuration, so that the inside of the process cartridge 30 is isolated from the environment around the process cartridge 30. As shown in FIG. 1, an air controller 32 is disposed in the process cartridge 30 for controlling the inside of the process cartridge 30. More specifically, the air controller 32 controls temperature and humidity inside the process cartridge 30 to preselected values. It is therefore not necessary to deal with different portions susceptible to the variation of temperature and that of humidity one by one. With this configuration, the illustrative embodiment can sufficiently protect image quality from degradation ascribable to temperature and humidity.

It sometimes suffices to control only one of temperature and humidity in protecting image quality from degradation, depending on the apparatus construction and toner material. In such a case, either one of temperature and humidity inside the process cartridge 30 should only be controlled to a preselected value.

The devices arranged in the process cartridge 30 may be confined in a highly air-tight case not removable from the printer body, in which case the air controller 32 will be disposed in the case. This is also successful to achieve the advantages stated above.

Hereinafter will be described a relation between the mean circularity of toner grains and black stripes, which characterizes the illustrative embodiment.

Toner applied to the illustrative embodiment is produced by polymerization and consists of grains each having a shape close to a true circle and therefore smooth surface. Therefore, a difference between the toner grains as to the amount of toner to deposit is small. In this condition, as shown in FIG. 4A, the charge distribution of the toner grains is narrow enough to enhance efficient image transfer for thereby reducing the amount of residual toner to be left on the drum 1. In light of this and taking account of experimental results, which will be described hereinafter, the illustrative embodiment uses toner grains having mean circularity of 0.95 or above.

EXPERIMENT 1

Experiment 1 was conducted to estimate the appearance of black stripes in an image by varying the mean circularity of toner grains. More specifically, a test machine 1 configured to clean the drum 1 having the protection layer 54 with a blade and a test machine 2 configured to clean it without a blade were compared. Also, the test machine 2 and a test machine 3 configured to clean the drum 1, which lacked the protection layer 54, without a blade were compared. Further, the test machines 2 and 3 each were implemented by the printer of the illustrative embodiment while the test machine 1 was provided with a cleaning blade formed of rubber in place of the brush roller 41.

After a black-and-white vertical stripe pattern of size A4 landscape had been printed on 50,000 sheets, black stripes to appear in images were estimated in five ranks by eye. Images without black stripes belonged to rank 5. The rank was sequentially lowered as 4, 3, 2 and 1 as the degree of black stripes was aggravated.

Figure 12:
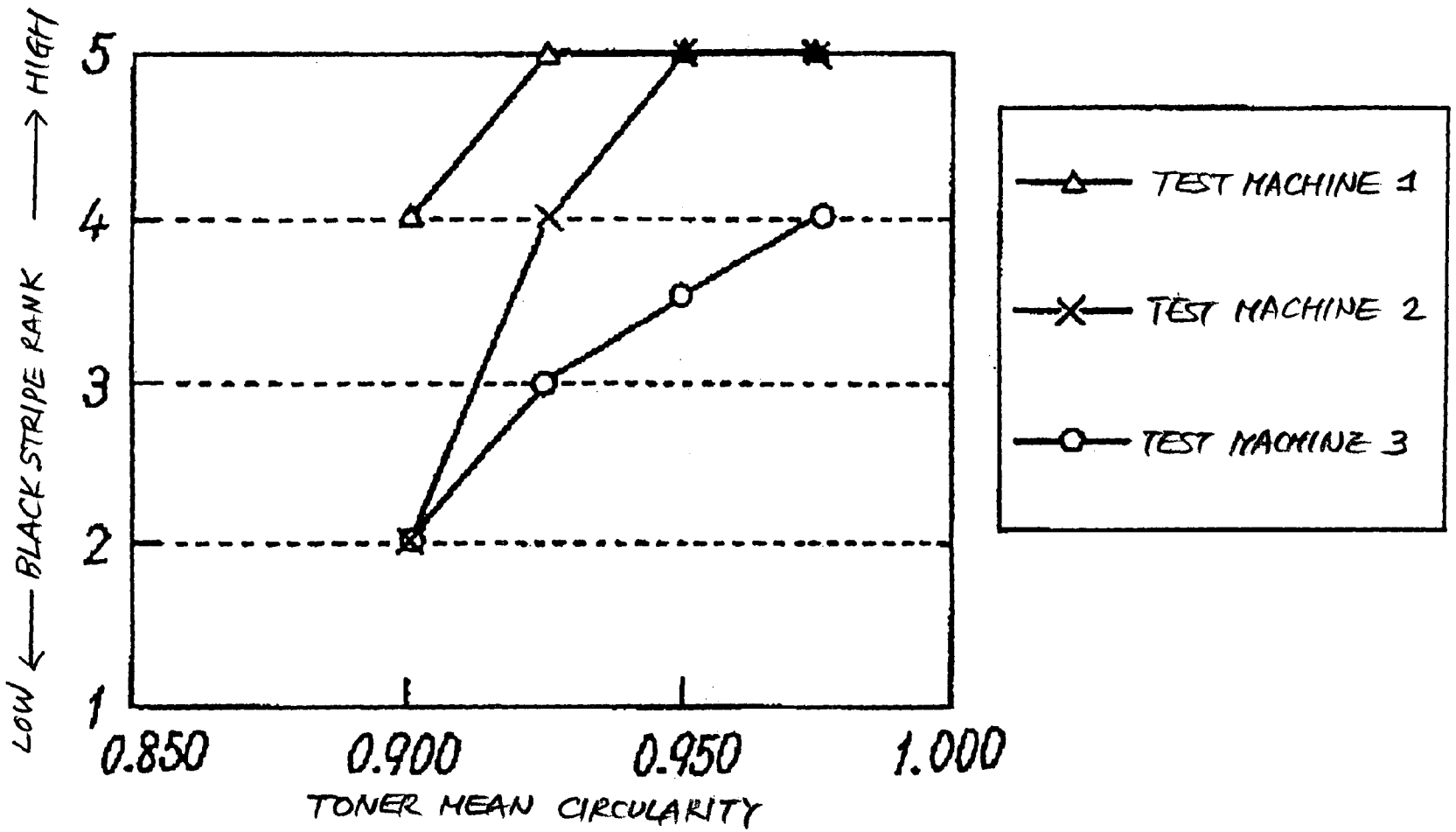
FIG. 12 is a graph showing the results of Experiment 1 conducted in a second embodiment of the present invention for estimating black stripes to appear in an image.

FIG. 12 is a graph showing the results of Experiment 1. As shown, the result of estimation as to black stripes tends to become more favorable with an increase in the mean circularity of toner grains in all of the test machines 1 through 3. This is presumably accounted for by the following.

By a series of researches and experiments, we found that scratches existed on the portions of the drum surface corresponding to black stripes and extended in the direction in which the drum surface moved. Presumably, therefore, toner grains deposit on the scratches without regard to whether or not a latent image is present there and are then transferred to the belt 10 in the form of black stripes. Why toner grains deposit on the scratches despite the absence of a latent image is presumably that defective charging occurs at the scratches and that toner grains are mechanically captured by the scratches. The deposition of toner grains on the scratches despite the absence of a latent image is presumably ascribable to an occurrence that while portions without the scratches are uniformly charged to −500 V by the charging device 5, portions with the scratches cause the potential to shift from −500 V toward the 0 V side due to defective charging. Why toner grains are mechanically captured by the scratches is presumably that toner grains, usually expected to deposit on the drum surface under the action of an electrostatic force of an electric field, are mechanically captured by the scratches when the developer enters the scratches.

Experiment 1 presumably reduced black stripes ascribable to at least the mechanical capture because the mean circularity of toner grains was increased. More specifically, toner grains with high circularity and therefore smooth surfaces are not easily mechanically captured by the scratches, compared to toner grains produced by, e.g., pulverization and having uneven surfaces. Further, such circular toner grains, if captured by the scratches, can easily escape the scratches when the following part of the developer rubs the scratches.

By comparing the experimental results derived from bladeless type of test machines 2 and 3, it will be seen that when the mean circularity of toner grains is 0.90 or above, the test machine 2, dealing with the drum 1 having the protection layer 54, has a greater margin as to black stripes than the test machine 3 dealing with the drum 1 lacking the protection layer 54.

As for the blade type of test machine 1, the highest black stripe rank 5 is achievable if the mean circularity of toner grains is 0.93 or above. By contrast, as for the bladeless type of test machine 2, black stripe rank 5 is not achievable unless the mean circularity of toner grains is 0.95 or above. It will therefore be seen that the blade type of test machine 1 has a greater margin as to black stripes than the bladeless type of test machine 2. Even the test machine 2, however, can implement the black stripe rank 5 if the mean circularity of toner grains is 0.95 or above, as mentioned above. This means that if the mean circularity of toner grains is 0.95 or above, black stripes can be almost obviated without regard to whether or not a cleaning blade is used.

EXPERIMENT 2

Experiment 2 was conducted to determine a relation between the number of prints output and the shaving of the drum surface. More specifically, Experiment 2 was conducted with toner grains having the mean circularity of 0.95 and by using the three test machines as in Experiment 1. An image of size A4 landscape and having an image area ratio of 5% was repeatedly printed. The amount of shaving of the drum surface was measured after 13,000 prints, 26,000 prints, 39,000 prints and 50,000 prints were output.

Figure 13:
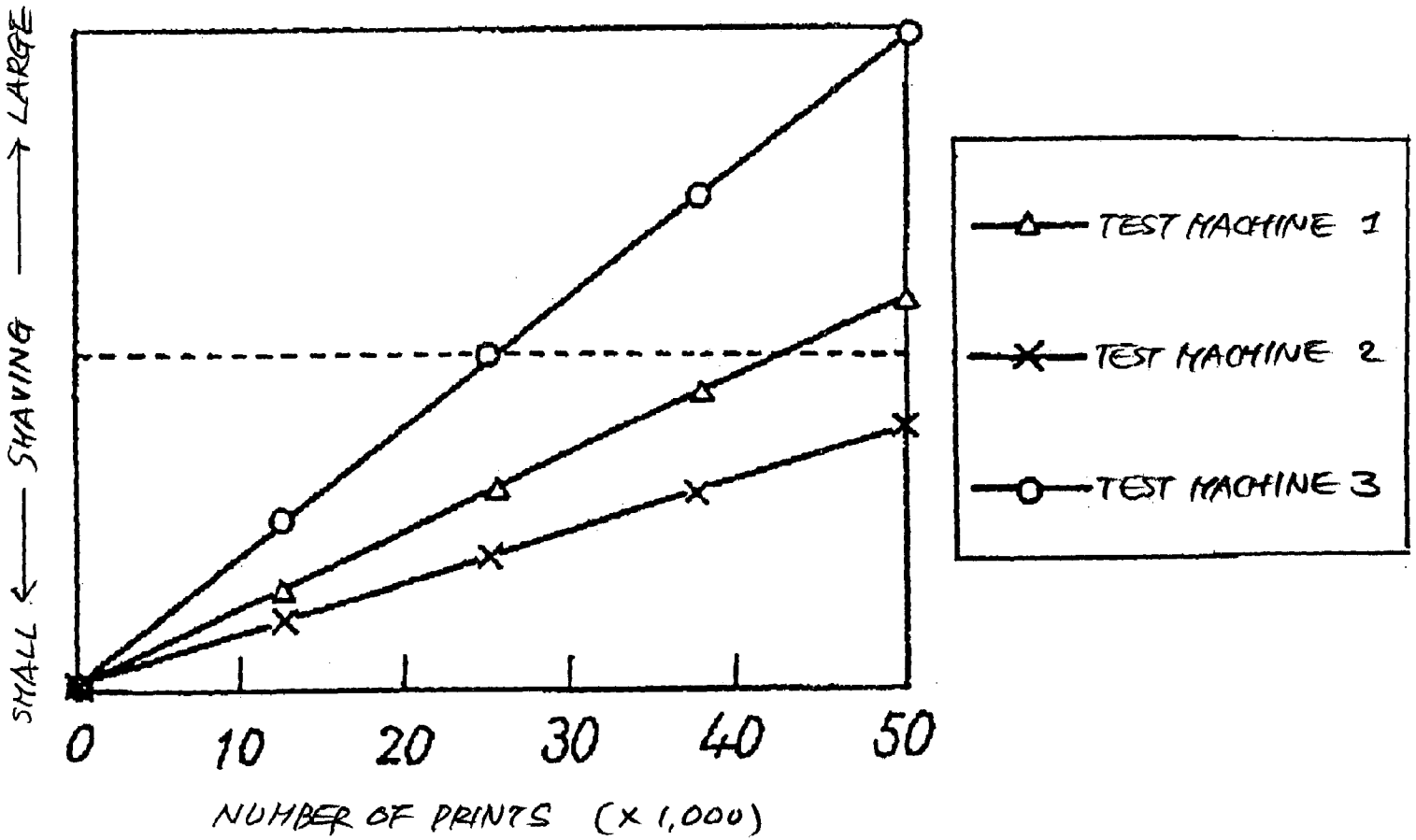
FIG. 13 is a graph showing the results of Experiment 2 and representative of a relation between the number of prints output and the shaving of the surface of the drum.

FIG. 13 is a graph showing experimental results obtained with Experiment 2. The amount of shaving is acceptable in practice so long as it lies in a range below a dotted line shown in FIG. 13. As shown, the amount of shaving increases with an increase in the number of prints in all of the test machines 1 through 3.

As also shown in FIG. 13, the bladeless type of test machine 3, dealing with the drum 1 lacking the protection layer 54, shaved the drum surface more than the bladeless type of test machine 2 dealing with the drum 1 having the protection layer 54 even when only a small number of prints were output. This is presumably because the protection layer 54, having higher hardness than the photoconductive layer, increased the durability of the drum surface against the rubbing of the brush roller 41.

Further, the blade type of test machine 1 shaved the drum surface more than the bladeless type of test machine 2 even when only a small number of prints were output. This is presumably because the brush roller 41 of the test machine 2 rubbed the drum surface with a weaker force than the blade of the test machine 1. The bladeless type of test machine 2 can therefore extend the life of the drum 1 more than the blade type of test machine 1.

The results of Experiments 1 and 2 described above prove that even a bladeless type of cleaning device can reduce black stripes to the same degree as a blade type of cleaning device and can make the life of the drum 1 longer than the latter if toner grains have mean circularity of 0.95 or above and if the drum 1 is provided with the protection layer 54.

Specific examples of the drum 1 included in the illustrative embodiment will be described hereinafter.

EXAMPLE 1

Figure 14:
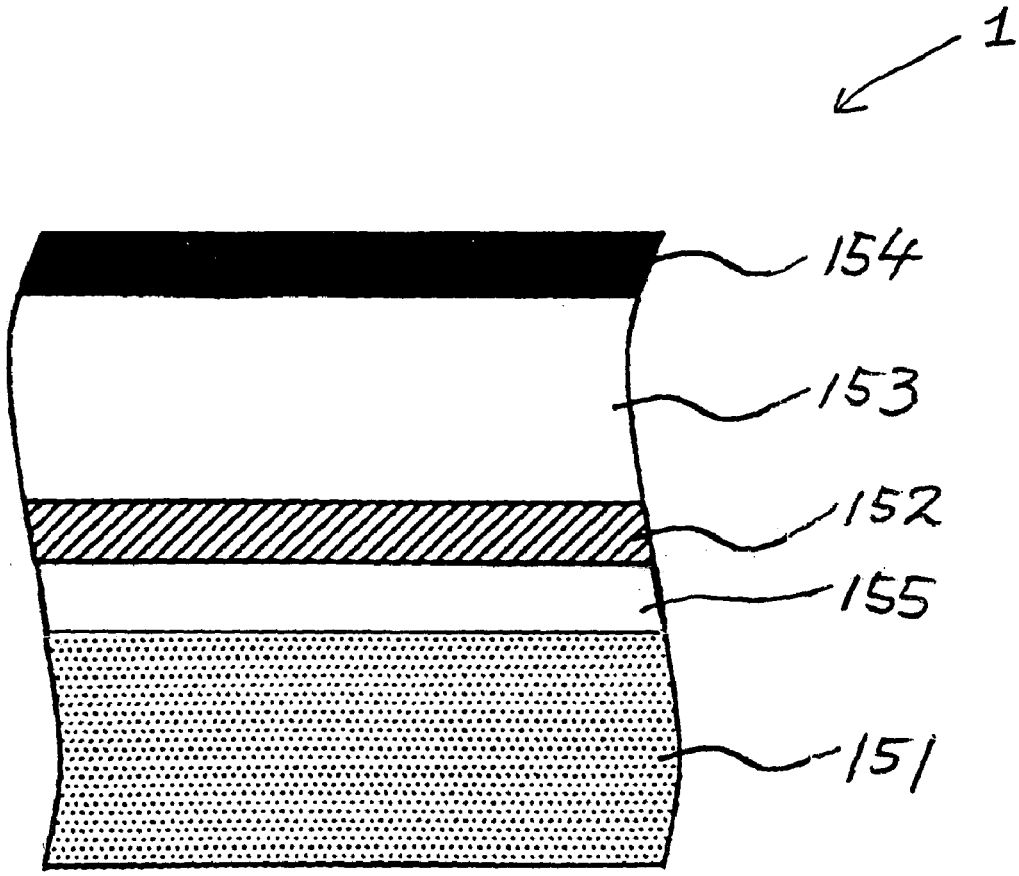
FIG. 14 is a section showing the configuration of the drum relating to Examples 1 through 3 of the second embodiment.

As shown in FIG. 14, in Example 1, a photoconductive drum was made up of a conductive base 151 formed of aluminum and having a diameter of 30 mm and a 3.5 μm thick under layer 155, a 0.2 μm thick charge generating layer 152, a 25 μm thick charge transporting layer 153 and a 5 μm thick protection layer 154 sequentially stacked on the base 151 by a procedure to be described hereinafter.

First, to form the under layer 155, 6 pts.wt. of alkyd resin Beckolite M6401-50 (trade name) available from DAINIPPON INK & CHEMICALS, LTD. and 4 pts.wt. of melamine resin Superbeckamine G-821-60 (trade name) also available from DAINIPPON INK & CHEMICALS, LTD. were dissolved in 200 pts.wt. of methyl ethyl ketone. Tinanium oxide was added to the resulting solution and then dispersed for 24 hours in a ball mill to thereby prepare a coating liquid. The coating liquid was then coated on the base 151 by dip coating and then dried for 20 minutes at 130° C. to thereby form the 3.5 μm thick under layer 155.

Figure 15:
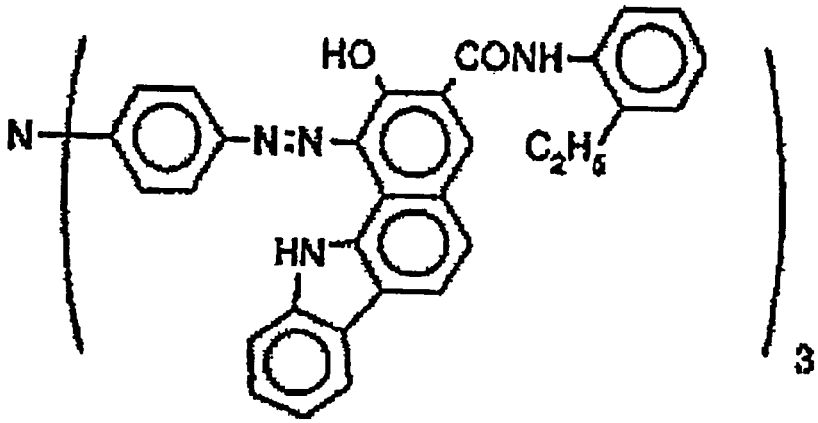
FIGS. 15 through 17 show formulae representative of substances constituting the layers of the drum shown in FIG. 14.

To form the charge generating layer 152, 0.25 pts.wt. of polyvinyl butyral, 200 pts.wt. of cyclohexanone, 2.25 pts.wt. of trisazo pigment represented by a formula shown in FIG. 15 and 80 pts.wt. of methyl ethyl ketone were mixed together to prepare a coating liquid. The coating liquid was then coated on the under layer 155 by dip coating and then dried for 20 minutes at 130° C. to thereby form the 0.2 μm thick charge generating layer 152.

Figure 16:
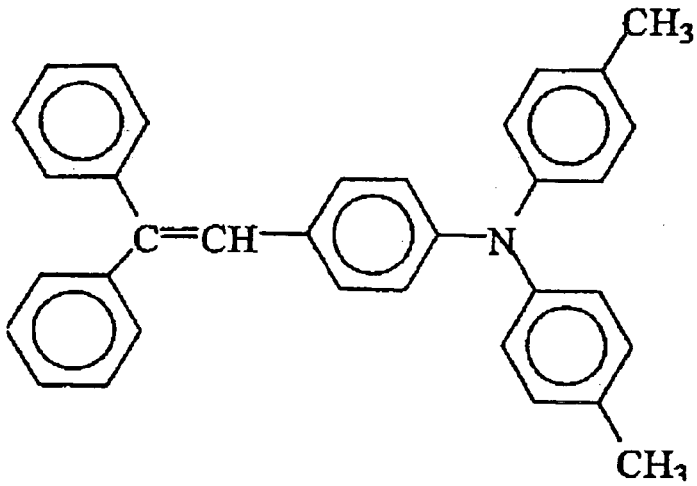

To form the charge transporting layer 153, 100 pts.wt. of methylene chloride, 10 pts.wt. of bisphenol-A-polycarbonate and 10 pts.wt. of low molecular weight and charge transporting substance represented a formula shown in FIG. 16 were mixed together. The resulting coating solution was coated on the charge generating layer 152 by dip coating and then dried for 20 minutes at 110° C. to thereby form the 25 μm thick charge transporting layer 153.

Figure 17:
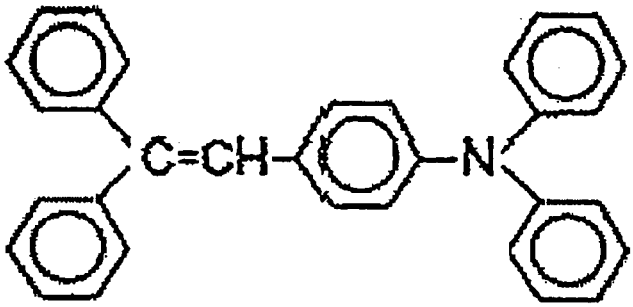

Further, to form the protection layer 154, 2 pts.wt. of charge transporting substance represented by a formula shown in FIG. 17, 4 pts.wt. of A-polycarbonate and 100 pts.wt. of methylene chloride were mixed together. The resulting coating liquid was coated on the charge transporting layer 153 by spray coating and then dried for 20 minutes at 110° C. to thereby form the 5 μm thick protection layer 154.

EXAMPLE 2

A photoconductive drum had the same structure as the photoconductive drum of Example 1 except for the protection layer 154. In Example 2, to form the projection layer 154, 4 pts.wt. of charge transporting layer shown in FIG. 16, 4 pts.wt. of A-polycarbonate, 1 pts.wt. of titanium oxide serving as a filler and 100 pts.wt. of methylene chloride were mixed together. The resulting coating liquid was coated on the charge transporting layer 153 by spray coating and then dried for 20 minutes at 100° C. to thereby form the protection layer 154 that was 2 μm thick.

EXAMPLE 3

Example 3 is identical with Example 2 except that titanium oxide, playing the role of a filler, was replaced with aluminum oxide.

The drums of Examples 1 through 3 each were mounted to a digital copier Imagio MF200 (trade name) available from RICOH CO., LTD. and subjected to continuous printing. Examples 1 through 3 all were determined to be excellent by total estimation including image density and resolution. An F/C ratio representative of the ratio of fluorine to carbon atoms present on the surface of the drum was 0. The F/C ratio is used as an index representative of the amount of deposition of a fluorine-based material present on the drum surface. Further, the thickness of the photoconductive layer decreased little from the initial value and insured stable, high definition hard copies over a long period of time.

As stated above, the illustrative embodiment can reduce black stripes with a bladeless type of cleaning system as with a blade type of cleaning system and can therefore extend the life of the drum while sufficiently controlling black stripes.

Third Embodiment

A third embodiment, directed mainly toward the third object stated earlier, will be described hereinafter. Because most part of the description made with reference to FIGS. 1 through 7 and 10, which show the first embodiment, directly apply to the third embodiment, the following description will concentrate only on differences between the first and third embodiments.

Figure 18:
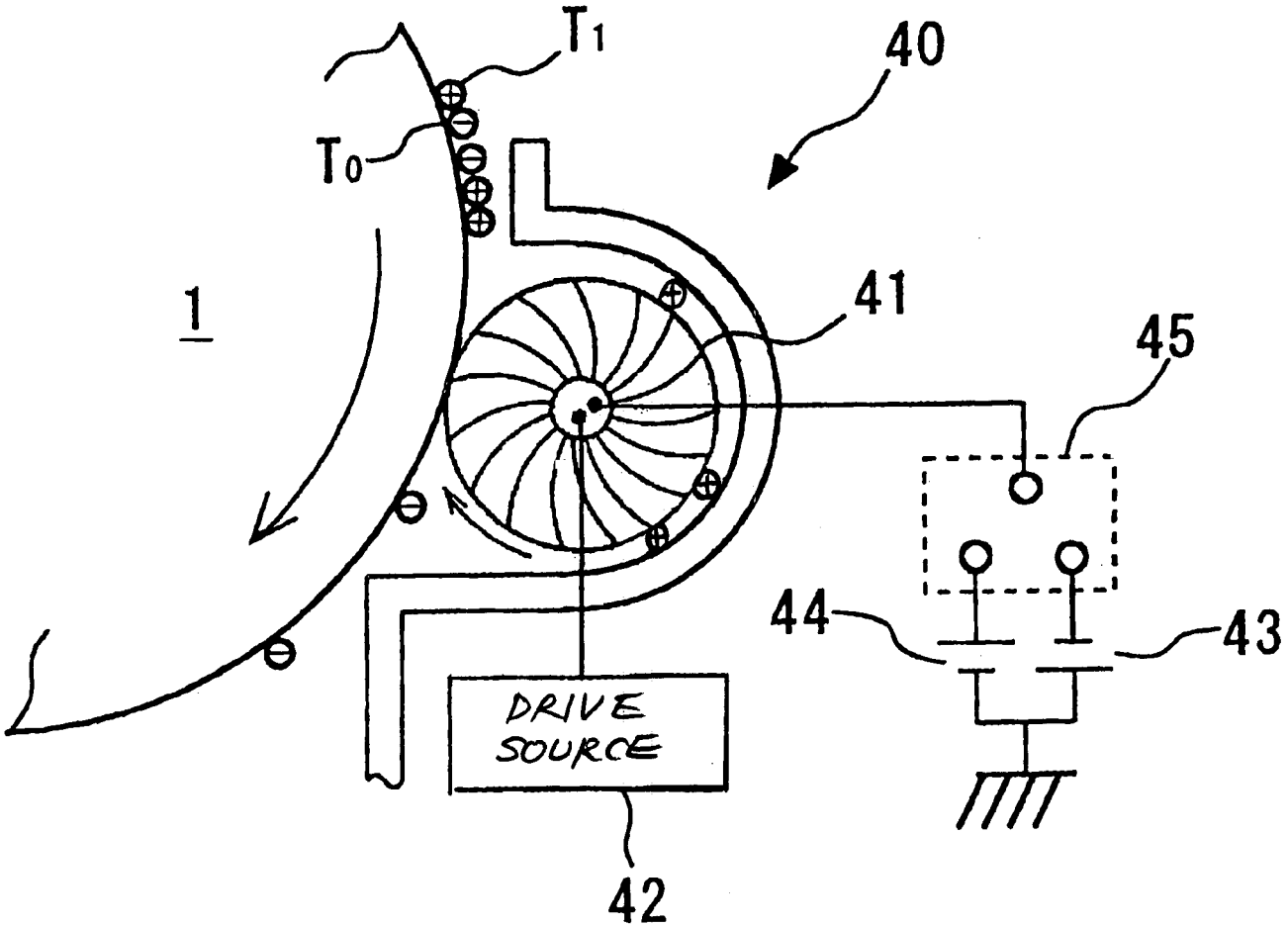
FIG. 18 is a view showing a toner holding device representative of a third embodiment of the present invention.

As shown in FIG. 18, the brush roller 41 of the illustrative embodiment has bristles thereof tilted beforehand such that their tips are directed in preselected directions, which are coincident with the direction in which the bristles yield. More specifically, in the illustrative embodiment, the drive source 42 causes the brush roller 41 to rotate in a direction indicated by an arrow in FIG. 18 such that the roots of the bristles approach the surface of the drum 1 before the tips of the same. With this configuration, the bristles of the brush roller 41 collapse little over a long period of time, maintaining the collection ratio of the toner grains $T_1$ of opposite polarity high. The brush roller 41, of course, achieves the various advantages described in relation to the first embodiment as well.

Figure 19:
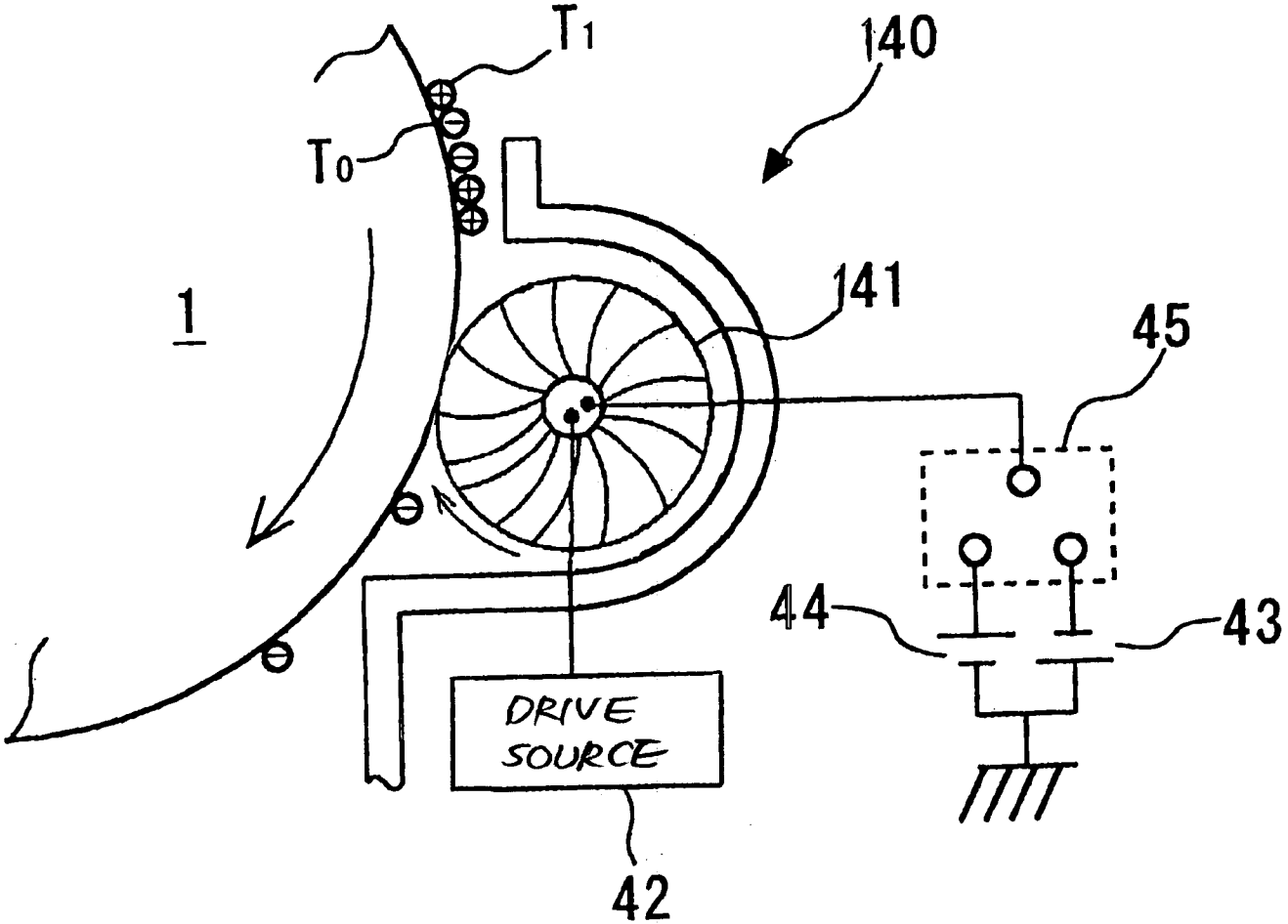
FIG. 19 is a view showing a brush roller included in a modification of the third embodiment.

FIG. 19 shows the toner holding device including a modified form of the brush roller 41. As shown, the toner holding device, labeled 140, includes a brush roller 141 mounted in the opposite position to the brush roller 40 such that the direction of tilt of the bristles is opposite to the direction of yield of the bristles. More specifically, in the modification, the drive source 42 causes the brush roller 141 to rotate such that the tips of the bristles approach the surface of the drum 1 before the roots of the same. In this condition, even when the brush roller 141 is left stationary with the tips thereof contacting the surface of the drum 1, the bristles easily restore the original position because the amount of deformation is large.

The modification, too, allows the brush roller 141 to scatter the residual toner left on the drum 1. Further, at the time when the brush roller 141 leaves the surface of the drum 1, the bristles sharply spring up to thereby release toner grains around their roots. This protects the function of the brush roller from degradation over a long period of time.

Moreover, in the modification, the brush roller 141 is rotated in the counter direction such that the linear velocity ratio of the brush roller 141 to the drum 1, as measured in the brush contact zone, is 1.2 or above, preferably 2.0 or above. In this condition, the brush roller 141 can efficiently collect the toner grains $T_1$ of opposite polarity while sufficiently controlling filming, as will be described more specifically in relation to Experiment 1 hereinafter.

EXPERIMENT 1

As for filming ascribable to silica parted from toner grains, we found the following after a series of extended researches and experiments.

Ozone, NOx and other discharge products are produced at the charging position and image transferring position and apt to deposit on the surface of the drum 1. Further, silica parted from toner grains has high affinity with the discharge products and therefore deposit on the surface of the drum 1 together with the discharge products. The silica thus deposited on the drum 1 is pressed against the drum 1 by the developer in the developing zone or by the brush roller and therefore firmly adheres to the drum 1, resulting in filming on the drum 1.

Silica deposited on the drum 1 may be removed by mechanically scraping it off. In fact, it has been customary to control filming by strongly scraping off silica with a cleaning blade. However, this cannot be done with the bladeless type of cleaning system.

We experimentally found that when a cleaning blade strongly scraped off silica when silica was present on the edge of the blade, and that such an effect was similarly achievable with a brush roller, i.e., a brush roller with a certain amount of silica deposited thereon could efficiently scrape off silica present on the drum 1. This indicates that silica is causative of filming when pressed by, e.g., the brush roller, but plays the role of an abrasive for scraping off silica at the same time. In addition, we found that the linear velocity ratio of the brush roller to the drum 1 played an important role in controlling filming. Experiment 1, conducted from such a viewpoint, will be described hereinafter.

Figure 20:
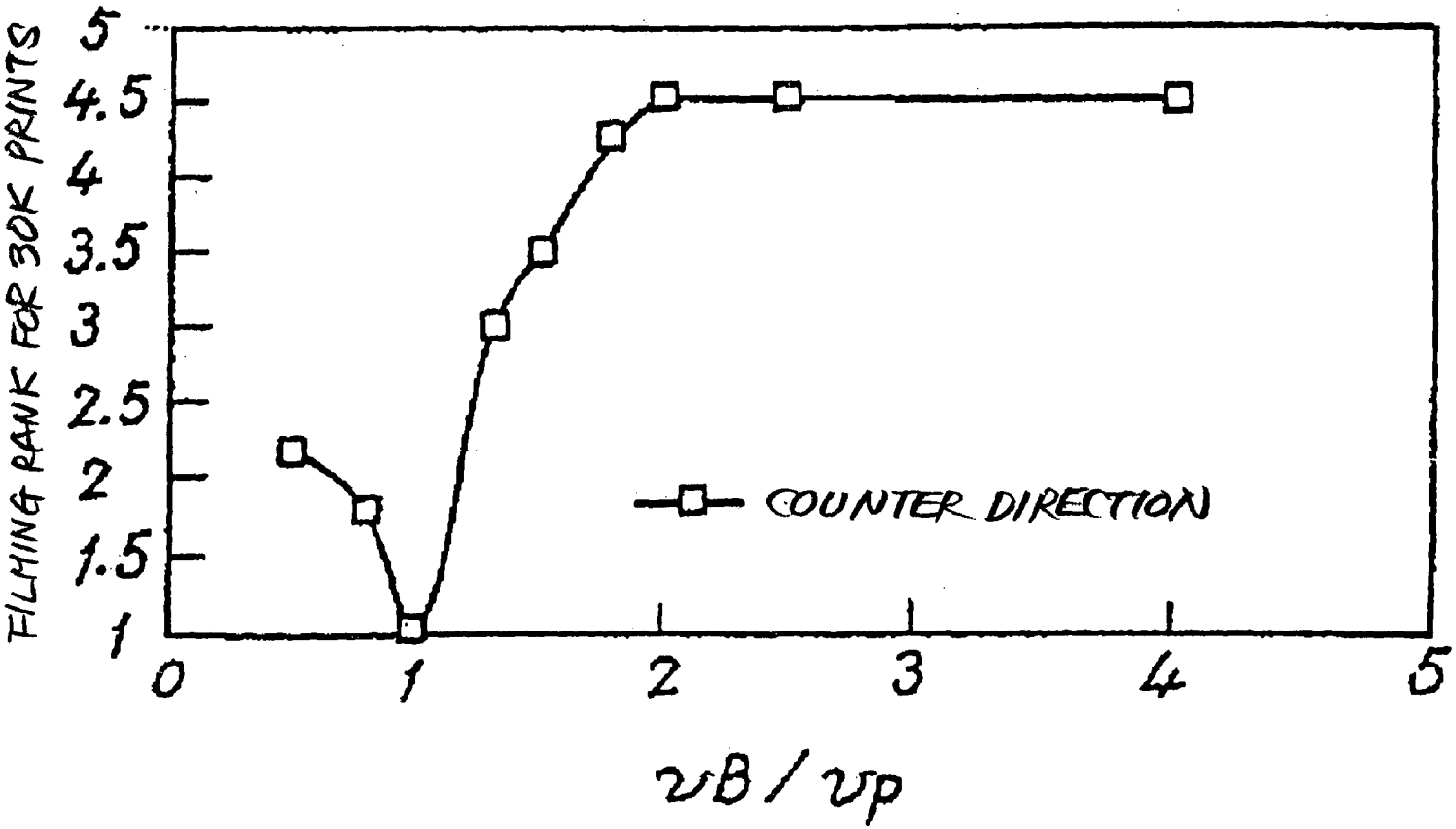
FIG. 20 is a graph showing the results of Experiment 1 conducted in the third embodiment.

FIG. 20 is a graph showing the results of Experiment 1. Assume that the surface of the drum 1 and that of the brush roller 141 are moved at linear velocities of vp and vB, respectively, and that the linear velocity ratio is vB/vp. In Example 1, the brush roller 141, includes in the modification described above, was caused to rotate at various speeds while filming was estimated in ranks 1 through 5 when 30,000 prints were output at each rotation speed.

For the estimation of filming, a photosensor was fixed in place at a preselected distance from the surface of the drum 1 in such a manner as to receive a light beam reflected from the drum 1. A current to be fed to a light emitting device was controlled such that the quantity of light incident to the photosensor was constant. For a new drum 1 and a given reference current, the filming rank was determined to be high when the increment of the reference current was small or determined to be low when the increment was large. The filming rank was 2.5 when the above increment was 1 mA; in ranks above 2.5, filming, if any, did not cause an image to be blurred or otherwise rendered defective. In this sense, filming ranks of 2.5 and above were determined to be allowable.

The drive source 42 causes the brush roller 141 to rotate in the direction counter to the direction of movement of the drum 1 in the brush contact zone such that the bristles are tilted in the direction opposite to the direction in which they yield, as stated earlier. In this condition, to implement the filming rank of 2.5 or above when 30,000 prints are output, the linear velocity ratio vB/vp must be 1.2 or above. Further, high filming ranks of 4.0 and above are not achievable unless the linear velocity ratio vB/vp is 2.0 or above. With such a large linear velocity ratio vB/vp, it is possible to enhance the effect that silica deposited on the brush roller scrapes off silica from the drum 1 for thereby obviating filming.

The filming rank may be slightly raised if the rotation speed of the brush roller 141 is lowered. This, however, presumably shifts the balance between the grinding effect available with silica present on the brush roller 141 and the occurrence of filming ascribable to the brush roller 141., which presses silica on the drum 1, toward the filming side. It follows that the filming rank cannot be raised over a certain limit by reducing the rotation speed of the brush roller 141.

Although a linear velocity ratio vB/vp around 1.2 slightly lowers the collection ratio of toner grains $T_1$ of opposite polarity, the evil of filming is more serious than the evil of the low collection ratio, as will be described in relation Experiment 2 hereinafter.

EXPERIMENT 2

Experiment 2 is identical with Experiment 1 except for the following. Originally, the brush roller 141 is configured to temporarily hold the toner grains of opposite polarity and then release them to the drum 1. The brush roller 141 must therefore be configured to collect the above toner grains as much as possible. We experimentally determined a relation between the collection ratio and the linear velocity ratio vB/vp.

Figure 21:
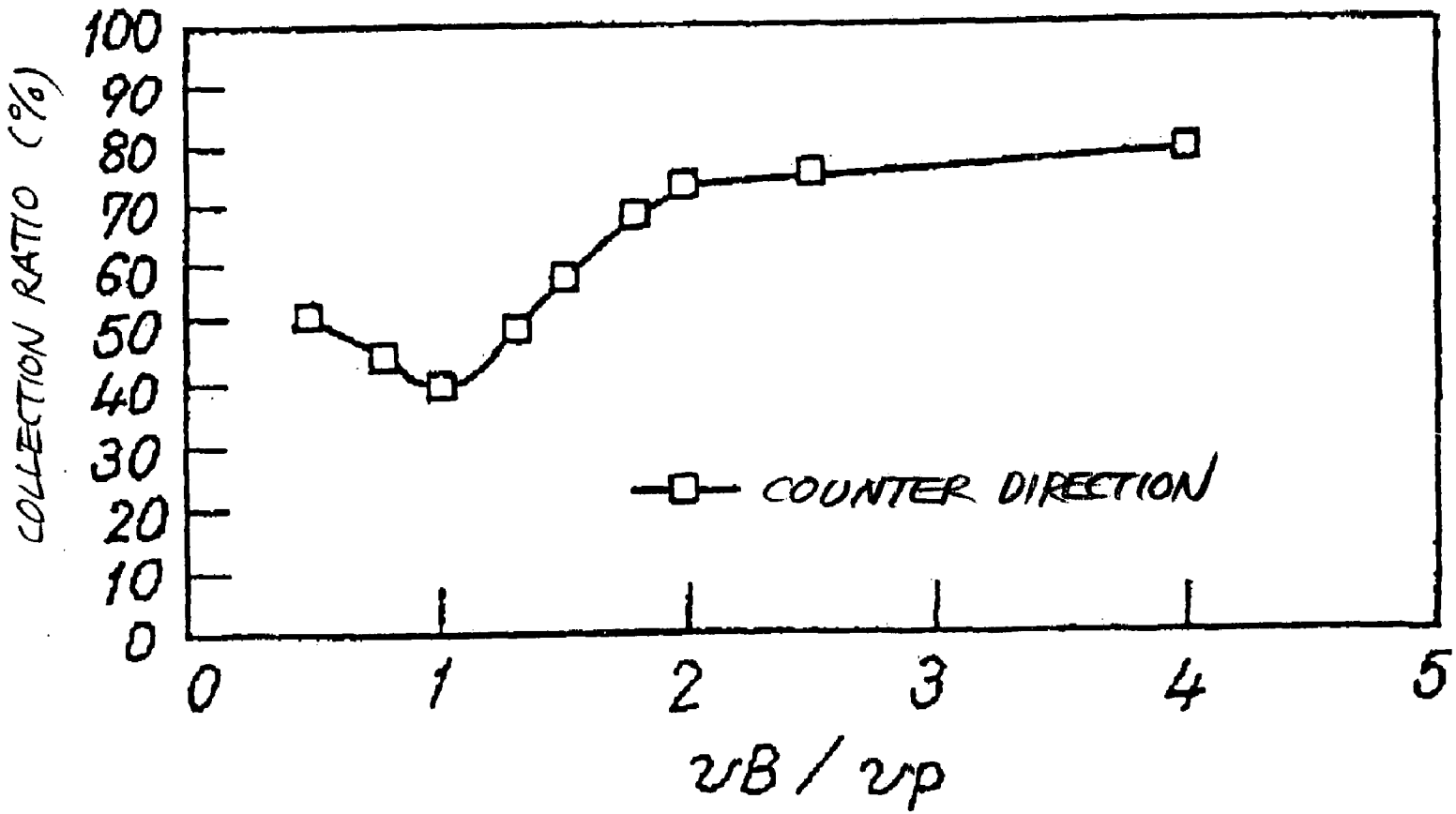
FIG. 21 is a graph showing the results of Experiment 2 conducted in the third embodiment.

FIG. 21 is a graph showing the results of Experiment 2. In Example 2, the brush roller 141 was rotated at various speeds while the collection ratio was estimated at each rotation speed. The collection ratio indicates the ratio of the amount of toner grains deposited on the brush roller 41 to the entire amount of toner grains deposited on the drum 1 by image transfer, but not reached the brush contact region.

As shown in FIG. 21, the collection ratio was lowest when the linear velocity ratio vB/vp was 1.0 and increased when the ratio vB/vp was higher than or lower than 1.0. To prevent the influence of the toner grains of opposite polarity from appearing in an image, the collection ratio must be at least 50% or above. To implement such a collection ratio, the linear velocity ratio vB/vp must be 1.4 or above.

As stated above, the illustrative embodiment can control the degradation of function of the brush member while making the most of the advantages of the bladeless cleaning system.

Fourth Embodiment

A fourth embodiment of the present invention, directed mainly toward the fourth object stated earlier, will be described hereinafter. Because most part of the description made with reference to FIGS. 1 through 7 and 10, which show the first embodiment, directly apply to the fourth embodiment as well, the following description will concentrate only on differences between the first and fourth embodiments.

While filming can be controlled by driving the brush roller 41 in the counter direction, as stated in relation to the first embodiment, filming is still apt to occur in a long time of use. In light of this, the illustrative embodiment provides the bristles of the brush roller 41 with volume resistivity between 20Ω·cm and $11\times10^8$Ω·cm, preferably between 55Ω·cm and $1\times10^8$Ω·cm. By applying an adequate bias to such a brush roller 41, it is possible to sufficiently control the occurrence of filming ascribable to silica parted from the toner grains, thereby protecting images from blur and other defects ascribable to filming, as will be described more specifically in relation to Experiment 1 later.

Figure 22:
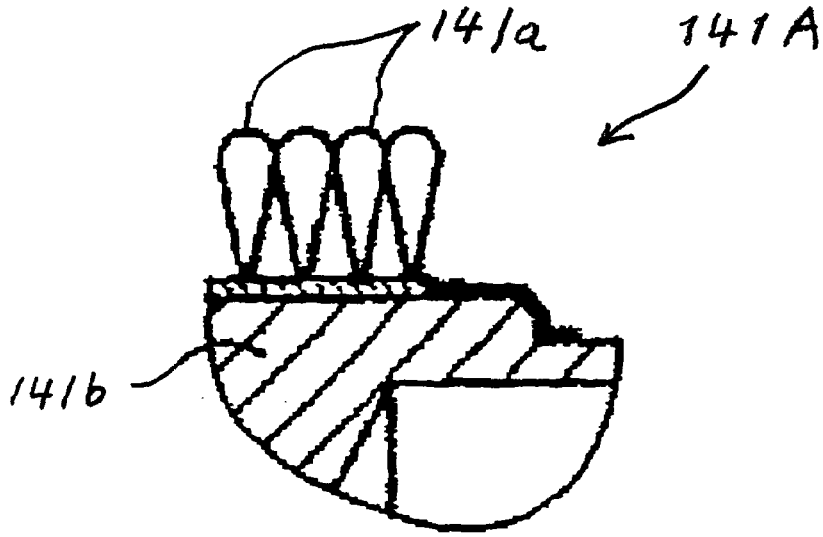
FIG. 22 is an enlarged view showing bristles included in a brush roller representative of a fourth embodiment of the present invention.

FIG. 22 shows a brush roller 141A made up of bristles 141*a* and a shaft portion 141*b*. As shown, each bristle 141*a* is affixed to the shaft portion 141*b* at opposite ends thereof in the form of a loop. Experiments showed that such loop bristles 141*b* reduced filming more than non-loop bristles. This is presumably accounted for by the following. At least part of the bristles 141*a* rubs the surface of the drum 1 with their portions surrounded by the loops crossing the direction of rubbing. At this instant, the loop portions of the bristles 141*a* rub the surface of the drum 1 in the form of edges. The brush roller 141A can therefore scrape off the additive deposited on the drum 1 and causative of filming more efficiently than a brush roller having non-loop bristles, thereby reducing filming.

In the illustrative embodiment, the brush roller 141A has loop density of 50 loops/inch$^2$ or above, but 600 loops/inch$^2$ or below. So long as the loop density lies in the above range, the brush roller 141A can exhibit the expected effect.

Figure 23A:
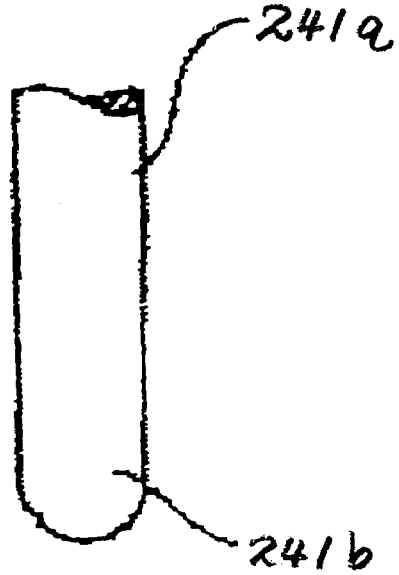
FIGS. 23A and 23B are enlarged views each sowing a particular modification of the bristles of the brush roller.
Figure 23B:
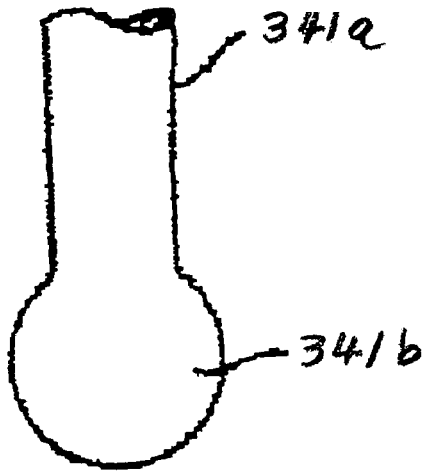

FIGS. 23A and 23B each show a particular modified form of the bristle 141*a*. As shown, bristles 241*a* and 341*a* both have spherical or substantially tips 241*b* and 341*b*, respectively. The bristles 241*a* and 341*a* with the spherical or substantially spherical tips 241*b* and 341*b*, respectively, each can reduce filming more than a bristle with a sharp tip, as determined in Experiment 3 to be described later. Further, the spherical tips 241*b* and 341*b*, which are not sharp, scratch the surface of the drum 1 little and therefore a minimum of defective images to appear. To provide the individual bristle with such a spherical tip, any one of conventional molding methods, including a heating method and a solvent method, may be suitably selected in matching relation to the material of the bristle.

EXPERIMENT 1

When the additives of the toner grains, particularly silica, part from the toner grains, they deposit on the drum 1 in the form of a film, as stated earlier. Part of the additives deposited on the drum 1 is charged to the same polarity as the toner grains of regular polarity due to friction acting between the toner grains and the carrier grains, as determined by experiments. It is therefore possible for the brush roller 41, applied with the hold bias, to remove such part of the additives from the drum 1 together with the toner grains of opposite polarity. On the other hand, while the collection ratio of the toner grains of opposite polarity increases with an increase in hold bias, an excessively high hold bias causes leak discharge to occur between the latent image on the drum 1 and the brush roller 41, resulting in the local omission of a solid image in the form of fine spots. Experiment 1 was conducted to determine the volumetric resistivity of the bristles of the brush roller 41 that could sufficiently reduce filming when an adequate hold bias was applied to the brush roller 41.

In Experiment 1, filming was ranked by applying an optimum hold bias to each of a plurality of brush rollers 41 different in volumetric resistivity from each other and estimating filming with each roller when 20,000 prints were output. Rank 5 is highest while rank 1 is lowest.

For the estimation of filming, a photosensor was fixed in place at a preselected distance from the surface of the drum 1 in such a manner as to receive a light beam reflected from the drum 1. A current to be fed to a light emitting device was controlled such that the quantity of light incident to the photosensor was constant. For a new drum 1 and a given reference current, the filming rank was determined to be high when the increment of the reference current was small or determined to be low when the increment was large. The filming rank was 2.5 when the above increment was 1 mA; in ranks above 2.5, filming, if any, did not cause an image to be blurred or otherwise rendered defective. In this sense, filming ranks of 2.5 and above were determined to be allowable.

Figure 24:
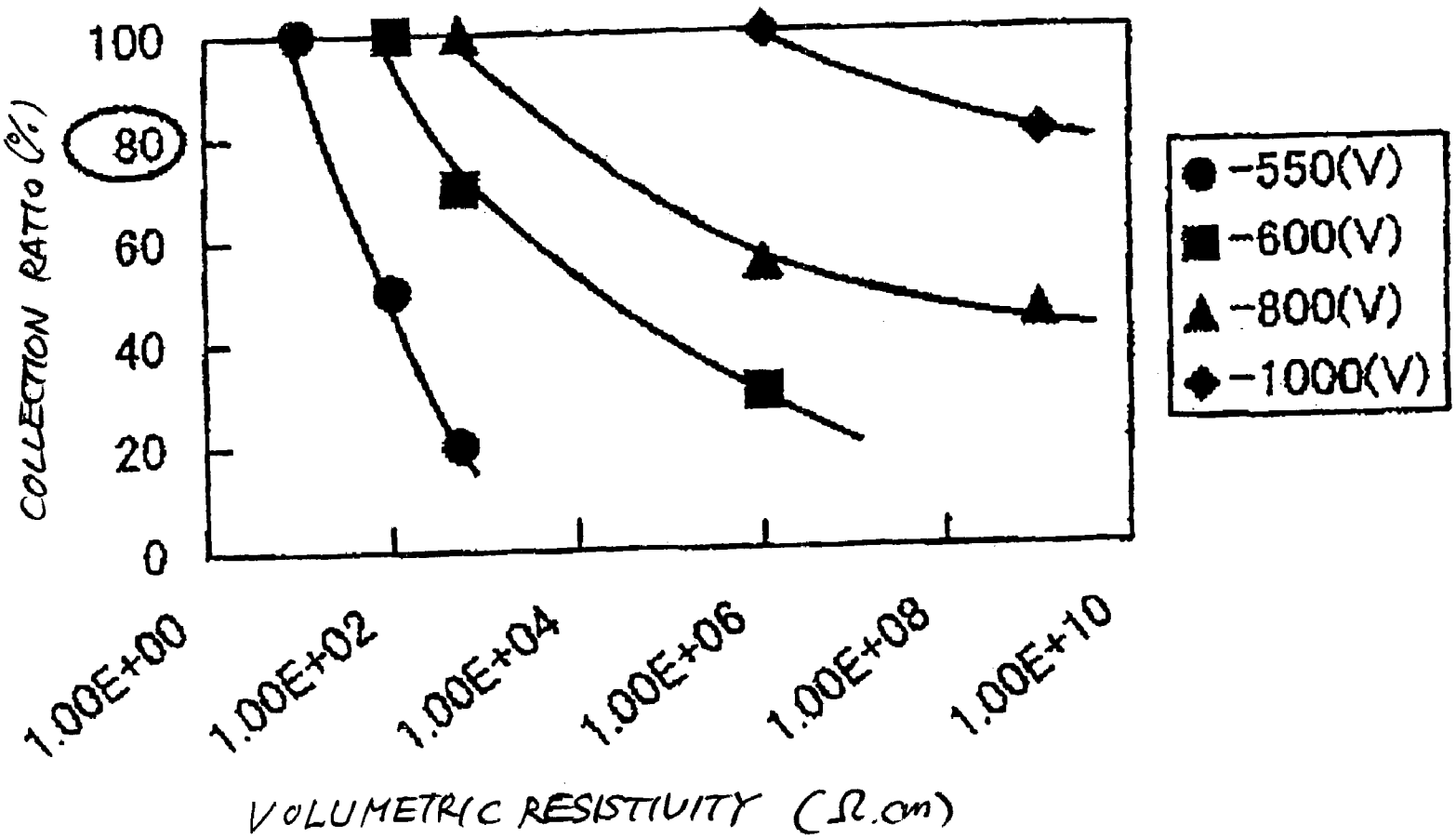
FIG. 24 is a graph showing a relation between the volumetric resistivity of the bristles and the toner collection ratio as plotted on a bias basis.

Before the estimation, experiments were conducted to determine the optimum hold bias to be applied to the brush roller 41. FIG. 24 is a graph showing a relation between the volumetric resistivity of the bristles of the brush roller 41 and the collection ratio of the toner grains of opposite polarity, as plotted on a hold bias basis. Because the background potential of the drum 1 is about −500 V, the hold bias must be lower than the background potential. On the other hand, if the hold bias is lower than −1,000 V, then leak discharge occurs without regard to the volumetric resistance of the bristles of the brush roller 41, resulting in white spots in a black solid image. In light of this, hold biases of −550 V, −600 V, −800 V and −1,000 V were used for experiments.

As FIG. 24 indicates, the higher the volumetric resistivity of the bristles of the brush roller 41, the higher the hold bias necessary for implementing a given collection ratio. It will also be seen that for a given volumetric resistivity of the bristles, the toner collection ratio increases with an increase in hold bias. A collection ratio of 80% or above is acceptable in practice as to image degradation ascribable to the toner grains of opposite polarity. In the case of bristles whose volume resistivity is $1\times10^{9}\Omega\cdot$cm, the collection ratio of 80% or above is not attainable unless the hold bias is at least −1,000 V. However, the hold bias of −1,000 V or above causes leak discharge to occur from the shaft portion of the brush roller 41 toward the drum 1, again resulting in white spots in an image.

It will be seen from the above that if the volumetric resistivity is $1\times10^{8}\Omega\cdot$cm or below, then the collection ratio of 80% or above can be implemented by the hold bias higher than 1,000 V that obviates the leak discharge toward the drum 1.

On the other hand, in the case of the brush roller 41 whose volumetric resistivity is $1\times10^{1}\Omega\cdot$cm, a substantially 100% collection ratio is attainable if the hold bias is at least −550 V. Therefore, the hold bias that obviates the leak discharge toward the drum 1 does not have to be applied to the brush roller 41 having the above low volumetric resistivity, so that image degradation ascribable to leak discharge is obviated.

In light of the above, Experiment 1 selected, among the hold biases that implemented the highest collection ratio, the lowest hold bias and applied the lowest bias to the plurality of brush rollers 41 each having particular volumetric resistivity. It is to be noted that the hold bias should preferably be as low as possible from the power consumption and power supply size standpoint as well.

Figure 25:
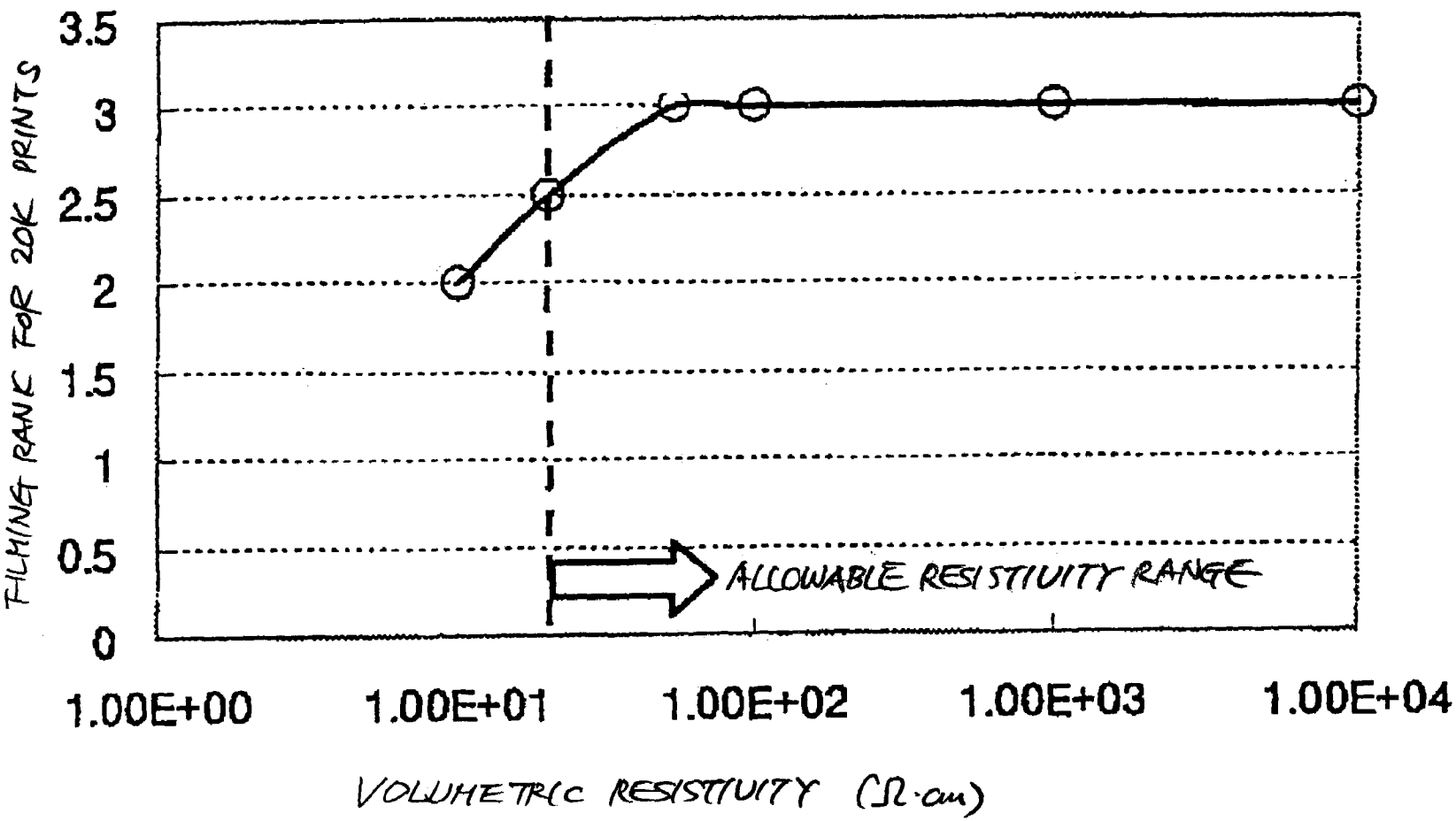
FIG. 25 is a graph showing the results of Experiment 1 conducted in the fourth embodiment.

FIG. 25 is a graph showing the results of Experiment 1, i.e., a relation between the volumetric resistivity of the brush roller 41 and the film rank determined with the optimum hold bias. In Experiment 1, the linear velocity ratio of the brush roller to the drum 1 was selected to be 1.2.

As shown in FIG. 25, film rank determined with the brush roller 41 having volumetric resistivity of $1\times10^{1}\Omega\cdot$cm was 2.0; an image was blurred. By contrast, film rank determined with the brush roller 41 having volumetric resistivity of $2.0\times10^{1}\Omega\cdot$cm was 2.5 and plotted on a dashed line in FIG. 25 was 2.5; although some filming occurred, it did not effect an image. Experiment 1 therefore showed that if the volumetric resistivity of the bristles of the brush roller 41 was $2.0\times10^{1}$ cm or above, then filming of the degree effecting an image was effectively obviated when the adequate hold bias was applied to the brush roller 41. It is to be noted that bristles with volumetric resistivity of $5.5\times10^{1}\Omega\cdot$cm or above realizes high filming rank of 3.0, i.e., further controls filming.

As stated above, Experiment 1 proved that when the volumetric resistivity of the bristles of the brush roller 41 was between $20\Omega\cdot$cm and $1\times10^{8}\Omega\cdot$cm, preferably between $55\Omega\cdot$cm and $1\times10^{8}\Omega\cdot$cm, there could be realized the collection ratio of 80% or above, obviated leak discharge toward the drum 1, and the effective control over filming effecting image quality.

We compared the brush roller 41 brought about filming of the degree effecting image quality and the brush roller 41 not brought about such a degree of filming by eye and found the following difference. The former had mush additives causative of filming deposited on the tip portions of the bristles while the latter did not. This is presumably because an increase in the volumetric resistivity of the bristles increases the optimum hold bias to be applied to the shaft portion of the brush roller 41 with the result that the potential around the shaft portion increases, successfully causing the additives to penetrate deeper into the brush roller 41. Consequently, the amount of additives to be pressed against the drum 1 at the tips of the bristles is presumably reduced, so that filming is reduced.

EXPERIMENT 2

Experiment 2 pertains to the force of the brush roller 41 for holding the toner grains of opposite polarity. In the illustrative embodiment, the brush roller 41 is required to firmly hold the toner grains of opposite polarity collected from the drum 1 until it releases them to the drum 1; otherwise, the toner grains would drop from the brush roller 41 and deposit on various members and devices around the brush roller 41. To solve this problem, in Experiment 2, after the application of the hold bias to the brush roller 41, carrying the toner grains thereon stopped, the brush roller 41 was left for 10 days in order to estimate the condition in which it held the toner grains.

More specifically, in Experiment 2, the optimum hold bias was applied to each of three brush rollers 41 having volumetric resistivities of $1\times10^1\Omega\cdot$cm, $1\times10^2\Omega\cdot$cm and $1\times10^3\Omega\cdot$cm, respectively. The three brush rollers were caused to collect and hold 50 mg, 100 mg and 150 mg of toner grains, respectively. Subsequently, assuming the power-off state of the printer body, the three brush rollers 41 were brought into an electrically floating condition and then left for ten days. FIG. 26 is a table listing the results of estimation effected with the above three brush rollers 41 as to the toner holding condition.

In FIG. 26, a circle indicates a condition wherein the toner grains dropped little while a triangle indicates a condition wherein some toner grains dropped. Further, a cross indicates a condition wherein the toner grains dropped by an amount critical in practical use. As FIG. 26 indicates, even when the amount of toner held by the brush roller 41 is as large as 150 mg or 200 mg, the toner holding force is at least acceptable in practical use only if the volumetric resistivity is $1\times10^2\Omega\cdot$cm. This is presumably because the amount of residual charge and therefore the toner holding force increased with an increase in volumetric resistivity.

EXPERIMENT 3

Experiment 3 was conducted to estimate filming by use of brush rollers 41 each being formed of a particular material and provided with a particular configuration. More specifically, in Experiment 3, brush rollers 41 all had bristles whose volume resistivity was substantially between $1\times10^3\Omega\cdot$cm and $1\times10^4\Omega\cdot$cm. As for the rest of the conditions, Experiment 3 is identical with the illustrative embodiment. That is, the background potential of the drum 1 is −500 V while the hold bias applied to each brush roller 41 is −700 V. Filming was ranked in the same manner as in Experiment 1. FIG. 27 lists the results of Experiment 3.

In FIG. 27, a circle indicates a case wherein filming belonged to rank 2.5 or above while a cross indicates a case wherein it belonged to ranks below 2.5. Further, a cross indicates a case wherein rank was sometimes 2.5 or above, but sometimes below 2.5, when confirmed a plurality of times.

When the bristles were formed of acrylic fibers and provided with sharp tips, filming rank was lowered to "X" when more than 60,000 prints were output. By contrast, when the bristles formed of acrylic fibers were provided with the loop configuration of the illustrative embodiment, filming rank was "Δ" or above up to 70,000 prints. This was also true with bristles formed of acrylic fibers and provided with spherical tips of the modification.

When the bristles were formed of acrylic fibers, coated with urethane and provided with sharp tips, filming rank was "Δ" or above up to 80,000 prints.

Filming rank was determined with bristles formed of materials other than acrylic fibers and provided with sharp tips as well. When bristles were formed of nylon fibers, filming rank was "Δ" or above up to 80,000 prints, when bristles were formed of polyester fibers, filming rank was "O" up to 70,000 prints. On the other hand, when bristles were formed of nylon fibers provided with conductivity by carbon, filming rank was "O" up to 80,000 prints. Further, when bristles were formed of polyester fibers provided with conductivity by carbon, filming rank was "O" up to 90,000 prints. To provide such fibers with conductivity, the fibers may be coated with a conductive material by plating, vacuum evaporation, sputtering or similar technology. Alternatively, an organic layer in which fine grains of carbon, metal or similar conductive substance are dispersed may be formed on the fibers. In Experiment 3, use was made of a method of effecting multiple-core composite spinning with carbon.

It will be seen from the above that for a given material, bristles with loop-like tips or spherical tips belong to a higher filming rank than bristles with sharp tips. Also, nylon fibers and polyester fibers are superior to acrylic fibers as to filming rank. Further, for a given material, bristles provided with conductivity improve filming rank.

As stated above, the illustrative embodiment sufficiently copes with filming while making the most of the advantages of the bladeless type of cleaning system.

Various modifications will become possible for those skilled in the art after receiving the teachings of the present disclosure without departing from the scope thereof.

What is claimed is:

1. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein said charging means is released from the surface of said image carrier until the toner grains of opposite polarity, released from said temporary holding means to the surface of said image carrier, move away from a charging zone.

2. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, wherein the bias for charging is interrupted from a time when the toner grains of opposite polarity, released from said temporary holding means to the surface of said image carrier, arrive at the position where said surface faces said charging member to a time when said toner grains move away from said position, and wherein said temporary holding means comprises a brush member configured to collect and hold the toner grains of opposite polarity and bias applying means, and said bias applying means selectively applies a bias for collecting and holding the toner grains of opposite polarity or a bias for releasing said toner grains to said image carrier to said brush member.

3. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein said developing means forms an electric field identical in direction with an electric field for development in a developing zone until the toner grains of opposite polarity, released from said temporary holding means to said image carrier, move away from said developing zone.

4. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein said image transferring means applies a bias opposite to the bias assigned to image formation until the toner grains of opposite polarity, released from said temporary holding means to said image carrier, move away from an image transferring zone.

5. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein the bias for charging is interrupted from a time when the toner grains of opposite polarity, released from said temporary holding means to the surface of said image carrier, arrive at the position where said surface faces said charging member to a time when said toner grains move away from said position, further comprising an intermediate image transfer body, wherein said image transferring means transfers the toner grains of opposite polarity present on said image carrier to said intermediate image transfer body.

6. The apparatus as claimed in claim 5, wherein said intermediate image transfer body is provided with cleaning means for removing toner grains from said intermediate image transfer body.

7. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, wherein the bias for charging is interrupted from a time when the toner grains of opposite polarity, released from said temporary holding means to the surface of said image carrier, arrive at the position where said surface faces said charging member to a time when said toner grains move away from said position, and wherein the organic fine grains present on the surface of the individual toner grain are formed of at least one of vinyl resin, polyurethane resin, epoxy resin, silicone resin, polyester resin, and fluorocarbon resin.

8. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein the charge control agent present on the surface of the individual toner grain comprises at least one of a metal complex of a metal salt of salicylate, an organic boron compound, a metal complex of a metal salt of oxynaphthoic acid, and a fluorine-containing ammonium salt compound.

9. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein the charge control agent present on the surface of the individual toner grain comprises at least one of an ammonium salt compound and a phenol compound.

10. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein assuming that the charge control agent exists on a surface of an individual toner mother grain in an amount of M and exists in an inside of said individual grain in an amount of T, then a ratio M/T is between 100 and 1,000.

11. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein toner grains have a volume-mean grain size of 3 μm to 8 μm and a dispersion degree of 1.25 or below in terms of a ratio of said volume-mean grain size Dv to a number-mean grain size Dn.

12. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein toner grains have a mean circularity of 0.93 or above.

13. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein toner grains each have a nitrogen atom distribution between a surface and an inside, nitrogen atoms being more densely distributed on said surface than in an entire toner grain.

14. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain, and wherein the bias for charging is interrupted from a time when the toner grains of opposite polarity, released from said temporary holding means to the surface of said image carrier, arrive at the position where said surface faces said charging member to a time when said toner grains move away from said position, further comprising a process cartridge removably mounted to a body of said apparatus and accommodating at least said image carrier and said temporary holding means.

15. In a toner stored in a developing device, which is included in an image forming apparatus, for developing a latent image formed on an image carrier also included in said image forming apparatus for thereby producing a corresponding toner image, said toner has a volume-mean grain size of 3 μm to 8 μm and a dispersion degree of 1.25 or below in terms of a ratio of said volume-mean grain size Dv to a number-mean grain size Dn, said image forming apparatus further comprising:

charging means for uniformly charging a surface of said image carrier with a charging member, which is applied with a bias of preselected polarity for charging, contacting or adjoining said surface;

latent image forming means for forming the latent image on the surface of said image carrier uniformly charged;

said developing device developing the latent image by depositing the toner, which has same polarity as the bias for charging on said latent image to thereby form the toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing; and collecting means for collecting the toner grains of opposite polarity, moved away from a position where the surface of said image carrier and said charging member face each other, from said surface;

wherein at least one of a charge control agent and organic fine grains is present on a surface of an individual toner grain.

16. The toner as claimed in claim 15, wherein said toner have a mean circularity of 0.93 or above.

17. The toner as claimed in claim 15, wherein toner grains each have a nitrogen atom distribution between a surface and an inside, nitrogen atoms being more densely distributed on said surface than in an entire toner grain.

18. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing;

bias interrupting means for interrupting application of the bias to said charging member from a time when the toner grains of opposite polarity, released from said temporary holding means to the surface of said image carrier, arrive at a position where surface and said charging member face each other to a time when said toner grains move away from said position; and collecting means for collecting the toner grains of opposite polarity, moved away from the position where the surface of said image carrier and said charging member face each other, from said surface, wherein said temporary holding means comprises:

a brush member comprising bristles contacting the surface of said image carrier; and selective bias applying means for selectively applying a hold bias of same polarity as the preselected polarity or a release bias of polarity opposite to said preselected polarity to said brush member.

19. The apparatus as claimed in claim 18, wherein said brush member comprises a brush roller rotatable while contacting the surface of said image carrier in such a manner to rub said surface.

20. The apparatus as claimed in claim 19, further comprising drive means for causing said brush roller to rotate such that a surface of said brush roller moves in a same direction as the surface of said image carrier at a position where said brush roller contacts said image carrier.

21. The apparatus as claimed in claim 19, further comprising drive means for causing said brush roller to rotate such that a surface of said brush roller moves in an opposite direction to the surface of said image carrier at a position where said brush roller contacts said image carrier.

22. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing;

bias interrupting means for interrupting application of the bias to said charging member from a time when the toner grains of opposite polarity, released from said temporary holding means to the surface of said image carrier, arrive at a position where surface and said charging member face each other to a time when said toner grains move away from said position; and collecting means for collecting the toner grains of opposite polarity, moved away from the position where the surface of said image carrier and said charging member face each other, from said surface, wherein said developing means forms an electric field between a developer carrier, which carries toner grains thereon, and the surface of said image carrier for causing the toner grains to move from said developer carrier toward the latent image, and an electric field of a same direction as the electric field for development is formed from a time when the toner grains of opposite polarity, released from said temporary holding means to the surface of said image carrier, arrive at a developing zone assigned to said developing means to a time when said toner grains move away from said developing zone.

23. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing;

bias interrupting means for interrupting application of the bias to said charging member from a time when the toner grains of opposite polarity, released from said temporary holding means to the surface of said image carrier, arrive at a position where surface and said charging member face each other to a time when said toner grains move away from said position; and collecting means for collecting the toner grains of opposite polarity, moved away from the position where the surface of said image carrier and said charging member face each other, from said surface, wherein an electric field opposite in direction to the electric field for image transfer is formed from a time when the toner grains of opposite polarity, released from said temporary holding means to the surface of said image carrier, arrive at an image transferring zone assigned to said image transferring means to a time when said toner grains move away from said image transferring zone.

24. The apparatus as claimed in claim 23, wherein said moving means comprises an endless moving member movable in contact with the surface of said image carrier, and said apparatus further comprises cleaning means for removing unnecessary toner grains from a surface of said endless moving member.

25. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image ori the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing;

bias interrupting means for interrupting application of the bias to said charging member from a time when the toner grains of opposite polarity, released from said temporary holding means to the surface of said image carrier, arrive at a position where surface and said charging member face each other to a time when said toner grains move away from said position; and collecting means for collecting the toner grains of opposite polarity, moved away from the position where the surface of said image carrier and said charging member face each other, from said surface, wherein the toner grains have a mean circularity of 0.93 or above.

26. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing;

bias interrupting means for interrupting application of the bias to said charging member from a time when the toner grains of opposite polarity, released from said temporary holding means to the surface of said image carrier, arrive at a position where surface and said charging member face each other to a time when said toner grains move away from said position; and collecting means for collecting the toner grains of opposite polarity, moved away from the position where the surface of said image carrier and said charging member face each other, from said surface, wherein said image carrier comprises a photoconductive element comprising a base, a photoconductive layer formed on said base, and a protection layer formed on said photoconductive layer.

27. An image forming apparatus comprising:

an image carrier;

charging means for uniformly charging a surface of said image carrier with a charging member, which is applied with a bias of preselected polarity for charging, contacting or adjoining said surface;

latent image forming means for forming a latent image on the surface of said image carrier uniformly charged;

developing means for developing the latent image by depositing a toner of same polarity as the bias for charging on said latent image to thereby form a corresponding toner image;

image transferring means for forming an electric field between said image carrier and a moving member whose surface is movable in contact with said image carrier to thereby transfer the toner image from the surface of said image carrier to a recording member or said moving member nipped between image carrier and said moving member;

temporary holding means for collecting, among residual toner grains left on the surface of said image carrier after transfer of the toner image, toner grains of opposite polarity charged to polarity opposite to the preselected polarity from the surface of said image carrier and then releasing said toner grains of opposite polarity to said surface at a preselected timing;

releasing means for maintaining said charging member released from the surface of said image carrier from a time when the toner grains of opposite polarity, released from said temporary holding means to said surface, arrive at a position where said surface and said charging member face each other to a time when said toner grains move away from said position; and collecting means for collecting the toner grains of opposite polarity, moved away from the position where the surface of said image carrier and said charging member face each other, from said surface.

28. The apparatus as claimed in claim 27, wherein said temporary holding means comprises:

a brush member comprising bristles contacting the surface of said image carrier; and selective bias applying means for selectively applying a hold bias of a same polarity as the preselected polarity or a release bias of a polarity opposite to said preselected polarity to said brush member.

29. The apparatus as claimed in claim 28, wherein said brush member comprises a brush roller rotatable while contacting the surface of said image carrier in such a manner to rub said surface.

30. The apparatus as claimed in claim 29, further comprising drive means for causing said brush roller to rotate such that a surface of said brush roller moves in a same direction as the surface of said image carrier at a position where said brush roller contacts said image carrier.

31. The apparatus as claimed in claim 29, further comprising drive means for causing said brush roller to rotate such that a surface of said brush roller moves in an opposite direction to the surface of said image carrier at a position where said brush roller contacts said image carrier.

32. The apparatus as claimed in claim 27, wherein said developing means forms an electric field between a developer carrier, which carries toner grains thereon, and the surface of said image carrier for causing the toner grains to move from said developer carrier toward the latent image, and an electric field of a same direction as the electric field for development is formed from a time when the toner grains of opposite polarity, released from said temporary holding means to the surface of said image carrier, arrive at a developing zone assigned to said developing means to a time when said toner grains move away from said developing zone.

33. The apparatus as claimed in claim 27, wherein an electric field opposite in direction to the electric field for image transfer is formed from a time when the toner grains of opposite polarity, released from said temporary holding means to the surface of said image carrier, arrive at an image transferring zone assigned to said image transferring means to a time when said toner grains move away from said image transferring zone.

34. The apparatus as claimed in claim 33, wherein said moving means comprises an endless moving member movable in contact with the surface of said image carrier, and said apparatus further comprises cleaning means for removing unnecessary toner grains from a surface of said endless moving member.

35. The apparatus as claimed in claim 27, wherein the toner grains have a mean circularity of 0.93 or above.

36. The apparatus as claimed in claim 27, wherein said image carrier comprises a photoconductive element comprising a base, a photoconductive layer formed on said base, and a protection layer formed on said photoconductive layer.

37. The apparatus as claimed in claim 27, further comprising a process cartridge removably mounted to a body of said apparatus and comprising at least said image carrier and said temporary holding means constructed integrally with each other.

* * * * *